US009580869B2

(12) United States Patent
Desai et al.

(10) Patent No.: US 9,580,869 B2
(45) Date of Patent: Feb. 28, 2017

(54) PROCESS FOR APPLYING HIGH VISCOSITY COMPOSITION TO A SHEET WITH HIGH BULK

(75) Inventors: Keyur Desai, Roswell, GA (US); Deborah J. Calewarts, Appleton, WI (US); Jian Qin, Appleton, WI (US); Jeffrey F. Jurena, Appleton, WI (US); Stephen Michael Campbell, Winneconne, WI (US); Donald E. Waldroup, Roswell, GA (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 1136 days.

(21) Appl. No.: 12/981,972

(22) Filed: Dec. 30, 2010

(65) Prior Publication Data

US 2012/0171440 A1 Jul. 5, 2012

(51) Int. Cl.

| | |
|---|---|
| ***B05D 1/28*** | (2006.01) |
| ***D21H 27/00*** | (2006.01) |
| ***D21H 19/68*** | (2006.01) |
| ***D21H 23/56*** | (2006.01) |

(52) U.S. Cl.

CPC ..... *D21H 27/002* (2013.01); *B05D 1/28* (2013.01); *D21H 19/68* (2013.01); *D21H 23/56* (2013.01); *Y10T 428/24934* (2015.01)

(58) Field of Classification Search

CPC ..... B05D 1/28

See application file for complete search history.

(56) References Cited

U.S. PATENT DOCUMENTS

| | | | | |
|---|---|---|---|---|
| 4,908,240 | A * | 3/1990 | Auhorn et al. | 427/391 |
| 5,686,169 | A * | 11/1997 | Hassall et al. | 428/195.1 |
| 5,814,188 | A * | 9/1998 | Vinson et al. | 162/109 |
| 5,851,352 | A * | 12/1998 | Vinson et al. | 162/112 |
| 6,610,174 | B2 * | 8/2003 | Sun et al. | 162/158 |
| 2003/0192662 | A1 * | 10/2003 | Heath et al. | 162/111 |
| 2008/0073045 | A1 * | 3/2008 | Dyer et al. | 162/112 |
| 2008/0295985 | A1 * | 12/2008 | Moncla et al. | 162/157.6 |

* cited by examiner

*Primary Examiner* — James M Mellott
(74) *Attorney, Agent, or Firm* — Dority & Manning, P.A.

(57) ABSTRACT

A process is disclosed for topically applying additive compositions to planar substrates, such as tissue webs. In one embodiment, the process is designed to apply relatively high viscous compositions to base sheets at high speeds in a manner that prevents the additive composition from penetrating into the sheet. The additive composition having the relatively high viscosity can be applied to the base sheet in one embodiment using an offset gravure printing process. The applicator roll includes a pattern of raised elements. The raised elements define a surface having at least one dimension that is less than 500 microns. The raised elements are also spaced closely together in order to prevent fiber buildup on the roll during relatively fast processing speeds.

3 Claims, 6 Drawing Sheets

PROCESS FOR APPLYING HIGH VISCOSITY COMPOSITION TO A SHEET WITH HIGH BULK

BACKGROUND

Low density webs that are used to produce absorbent tissue products (e.g. facial tissues, bath tissues and other similar products) are designed to include several important properties. For example, it is desirable that the products have good bulk, a soft feel and absorbency. It is also desired that the product have good strength and resist tearing, even while wet. Unfortunately, it is very difficult to produce a high strength tissue product that is also soft and highly absorbent. Usually, when steps are taken to increase one property of the product, other characteristics of the product are adversely affected.

For instance, softness is typically increased by decreasing or reducing cellulosic fiber bonding within the tissue product. Inhibiting or reducing fiber bonding, however, adversely affects the strength of the tissue web.

Softness may be enhanced by the topical addition of a softening agent to the tissue web. For example, recently those skilled in the art have proposed applying aqueous dispersions containing polymer particles to tissue webs for increasing softness. Such polymer dispersions are disclosed, for instance, in U.S. Pat. No. 7,785,443, U.S. Pat. No. 7,820,010, U.S. Pat. No. 7,807,023 and U.S. Patent Application Publication No. 2008/0073045, which are all incorporated herein by reference. In the above patents and patent application, the aqueous dispersion contains an alpha-olefin polymer, an ethylene-carboxylic acid copolymer, or mixtures thereof. In addition to increasing softness, the polymer dispersion has been found to reduce lint, sheet to sheet adhesion, and even improve strength. In fact, the above patents and patent application represent great advances in the art.

Problems have been experienced, however, in applying the above polymer dispersions to tissue webs. More particularly, problems have been experienced in applying the polymer dispersions to tissue webs without having to crepe the webs. When applying the polymer dispersion without the assistance of a creping surface, the dispersion can either be applied to the web before drying while the web is still wet or after drying in a post-treatment stage. Unfortunately, if the dispersion is applied to a low density web in the above situations, it tends to penetrate the web which can increase the stiffness of the product. Thus, a need exists for a process for applying compositions, such as polymer dispersions, to base sheets such that the composition remains on the surface of the sheet in controlled amounts. A need also exists for a process capable of applying a composition to a surface of a base sheet at normal processing speeds.

SUMMARY

The present disclosure is generally directed to a process for applying additive compositions to base sheets. Base sheets that may be treated in accordance with the present disclosure include higher bulk or lower density products that may contain pulp fibers. The base sheet, for instance, may comprise a tissue web, a coform web, a hydroentangled web, or the like. The base sheet may be used to produce bath tissue, facial tissues, paper towels, industrial wipers, wet wipes, or other similar products. In accordance with the present disclosure, additive compositions are applied to base sheets at relatively high processing speeds and in a manner that maintains the additive composition on the surface of the sheet.

Specifically, the process of the present disclosure uses relatively high viscosity compositions in combination with the use of a micro-patterned compressible surface for applying the additive to the surface of a substrate. The micro-patterned surface may comprise the surface of a roll that is part of an offset gravure printing system. As will be described in greater detail below, the above combination has been found to very efficiently apply additive compositions to surfaces of a substrate at relatively high processing speeds while minimizing problems during printing and coating, such as fiber buildup on the application surface. The process is also capable of controlling not only the amount of composition applied to the sheet but also the location where the composition is applied.

In one embodiment, for instance, the present disclosure is directed to a process for applying an additive composition to the surface of a planar substrate. The process includes first applying an additive composition to a surface, such as to the surface of a first roll. The additive composition can be applied to the surface of the first roll using various techniques, such as spraying, dipping, or using a meyer rod. Once the additive composition is applied to the first surface, the additive composition is then transferred to a second surface, such as the surface of a second roll. The surface of the second roll may comprise a compressible material defining a pattern of raised elements. At least certain of the raised elements have a surface that has at least one dimension of less than about 500 microns. In addition, the raised elements are spaced apart a distance of less than about 500 microns measured from a center of one element to a center of an adjacent element.

In accordance with the present disclosure, the additive composition is applied from the surface of the second roll to a surface of the planar substrate. The planar substrate may comprise any of the base sheets described above, such as a tissue web. The additive composition contains a polymeric material and has a viscosity of at least 500 cps. The additive composition is applied to the surface of the planar substrate so as to cover at least 20% of the surface area of one side of the substrate. In accordance with the present disclosure, the planar substrate is also moving at a speed of at least 200 ft/min, such as at least 500 ft/min, such as from about 500 ft/min to about 5000 ft/min during application of the additive composition.

The shape and arrangement of the raised elements on the surface of the second roll can vary depending upon the particular application and the desired result. In one embodiment, for instance, the raised elements comprise lines having a width of less than 500 microns, such as having a width of from about 50 microns to about 200 microns. The lines can be linear or curved. In one embodiment, for instance, the lines may be substantially linear and parallel with each other. The lines can be perpendicular, parallel or oblique to the moving direction of the planar substrate.

The lines can also be spaced apart a distance of less than about 500 microns when measured from a center of one line element to the center of an adjacent line element. When the raised elements comprise line elements, the center of the line element refers to a line that runs through the middle of the width of the line element. In general, the raised elements can be placed as close together as possible. For instance, in various embodiments, the line elements may be spaced apart a distance of from about 10 microns to about 500 microns, such as a distance of from about 25 microns to about 400 microns, such as a distance of from about 50 microns to about 300 microns. In one embodiment, the line elements have a width of about 100 microns and are spaced apart a distance of about 100 microns.

In addition to the raised elements being in the shape of lines, the raised elements may also be in the form of discrete shapes. For instance, in one embodiment, the raised elements may have a circular shape having a diameter of from about 50 microns to about 500 microns, such as from about 50 microns to about 200 microns. In one embodiment, the raised elements in the form of discrete shapes may be present in a pattern such that all adjacent elements are less than 500 microns apart measured from a center of one discrete shape to the center of an adjacent discrete shape. The raised elements, for instance, may be spaced apart the same distances as described above with respect to the line elements.

As described above, the additive composition applied to the planar substrate generally has a relatively high viscosity, such as a viscosity of greater than about 500 cps. For instance, the viscosity of the additive composition can be from about 800 cps to about 2500 cps, such as from about 800 cps to about 2000 cps. The additive composition can comprise any composition having the above viscosity where there is benefit to maintaining the composition on the surface of the sheet. The additive composition may be applied to the sheet at ambient temperature or at an elevated temperature.

In one embodiment, for instance, the additive composition comprises an aqueous dispersion containing an alpha-olefin interpolymer. The alpha-olefin interpolymer may be present in the dispersion in the form of small particles having a diameter of from about 0.5 microns to about 3 microns. The composition can have a solids content sufficient to have a viscosity of greater than about 500 cps. In one embodiment, for instance, the aqueous dispersion may have a solids content of from about 30% to about 60%. In addition to containing an alpha-olefin interpolymer, the dispersion may also contain various other additives, such as a dispersing agent. In one embodiment, for instance, an ethylene-carboxylic acid copolymer is present in the composition as a dispersing agent.

In addition to aqueous dispersions, it should be understood that various other additive compositions may be applied to substrates in accordance with the present disclosure. For instance, in other embodiments, the additive composition may comprise a lotion in the form of an emulsion. In yet another embodiment, the additive composition may comprise a debonder.

The present disclosure is also directed to tissue products comprising a base sheet containing pulp fibers and having a bulk of greater than about 3 cc/g. The base sheet can include a first surface and a second surface. An additive composition is applied to at least one surface of the base sheet according to the process described above. For instance, the treated areas on the base sheet can have at least one dimension that is less than about 500 microns, such as less than about 250 microns, such as less than about 100 microns. The treated areas can be spaced apart a distance of less than about 500 microns, such as less than about 100 microns, such as less than about 50 microns, such as even less than about 10 microns. The treated areas may comprise discrete shapes or may comprise parallel rows. The treated areas may cover from about 20% to about 80% of the first surface of the base sheet and may be applied to the base sheet so as to reduce slough by at least 10%, such as by at least 20%, such as by at least 30%, such as even by at least 40% in comparison to a surface of an identical base sheet that is not treated.

Other features and aspects of the present disclosure are discussed in greater detail below.

BRIEF DESCRIPTION OF THE DRAWINGS

A full and enabling disclosure of the present invention, including the best mode thereof to one skilled in the art, is set forth more particularly in the remainder of the specification, including reference to the accompanying figures, in which.

Figure 1:
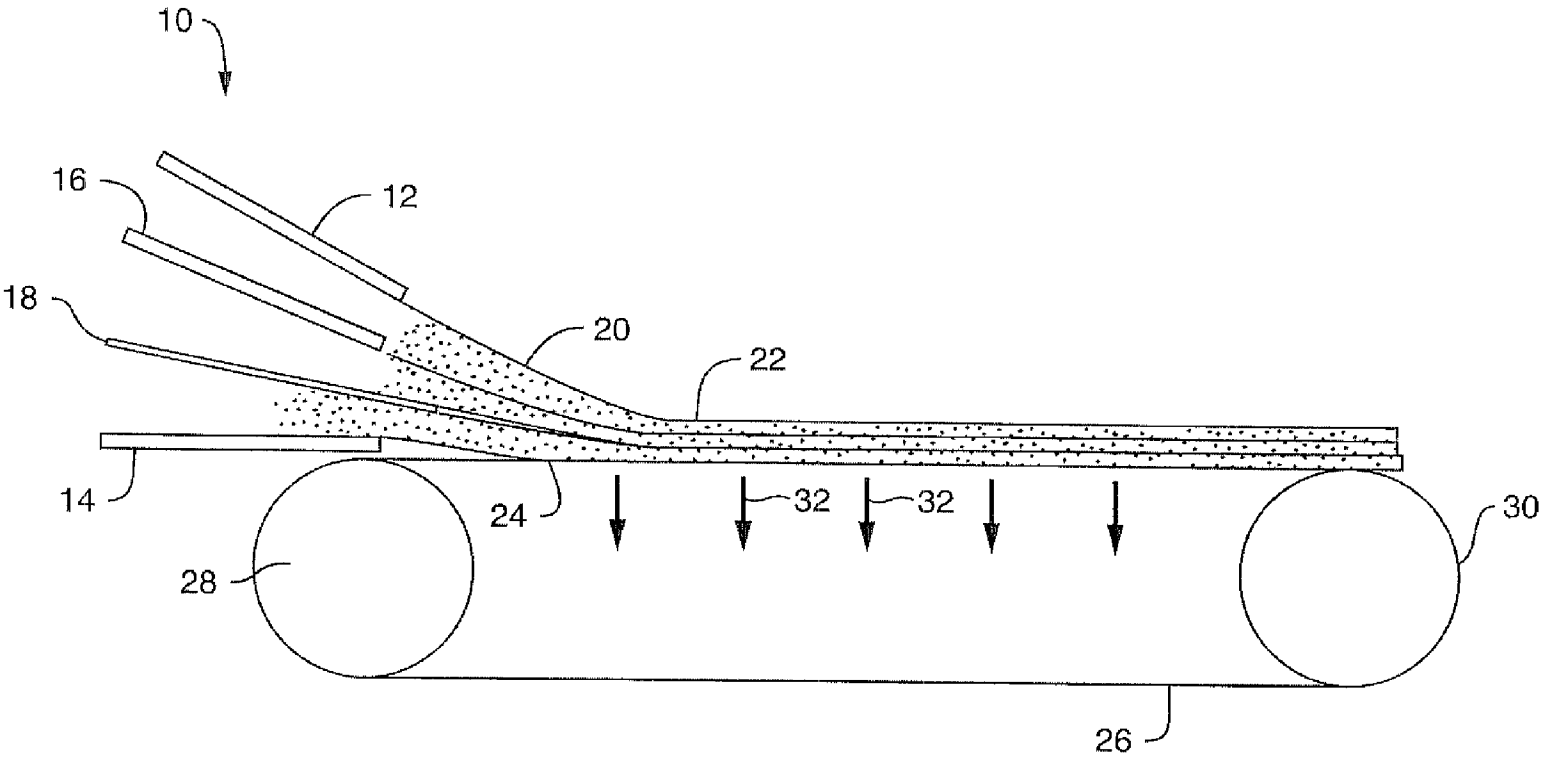
FIG. 1 is a schematic view of a device for forming a multi-layer stratified pulp furnish.

Repeat use of reference characters in the present specification and drawings is intended to represent the same or analogous features or elements of the present invention.

DETAILED DESCRIPTION

It is to be understood by one of ordinary skill in the art that the present discussion is a description of exemplary embodiments only, and is not intended as limiting the broader aspects of the present disclosure.

In general, the present disclosure is directed to a process for applying an additive composition to the surface of a planar substrate, such as a low density, high bulk web. The additive composition can be applied to the substrate for any suitable purpose. For instance, the additive composition may improve the softness and/or feel of the substrate. In other embodiments, the additive composition may increase the strength or otherwise alter another property of the substrate. In one embodiment, the additive composition may comprise an aqueous dispersion containing polymer particles that, when applied to a base sheet, may not only improve softness and/or the feel of the sheet, but may also improve various other properties.

In accordance with the present disclosure, the additive composition is applied to the surface of a substrate at a relatively high viscosity so that a significant portion of the additive composition remains on the surface of the substrate instead of being absorbed into the substrate. In addition, the present disclosure is directed to using a particular type of patterned surface for applying the high viscosity composition to the substrate without having to crepe the substrate. The patterned surface, for instance, may comprise the surface of a flexographic roll. The surface includes raised elements defining a surface that has at least one relatively small dimension. The raised elements are also spaced close together. As will be described in greater detail below, patterns of raised elements on the transfer surface designed in accordance with the present disclosure allow for application of a high viscosity composition to a high bulk base sheet at fast speeds without adverse consequences, such as fiber buildup on the transfer surface during the process which could affect machine run efficiency and cause breakage of the base sheet. The design of the transfer surface also provides control over surface coverage of the composition on the substrate as well as add-on, which refers to the amount of composition applied to the substrate. In one embodiment, products can be made according to the present disclosure at very high speeds and with improved soft hand feel.

In the past, polymer dispersions have been applied to substrates using a direct spray process, direct gravure printing, wet-end addition, solution coating, direct foam application, and size press application. The above processes, however, are either not well suited to applying high viscosity compositions to a substrate and/or do not provide controlled surface area coverage and add-on. Using a micro-patterned roll in accordance with the present disclosure, however, has provided various improvements over the above processes. For instance, high bulk base sheets having a bulk of greater than 3 cc/g can be treated in accordance with the present disclosure with an additive composition having a viscosity greater than 500 cps at processing speeds greater than 200 ft/min, such as greater than 500 ft/min, such as even greater than 1000 ft/min.

Various different substrates or base sheets may be treated in accordance with the present disclosure. In one embodiment, the base sheet contains pulp fibers, such as in an amount greater than about 50% by weight. The pulp fibers may be present in the base sheet alone or in combination with synthetic fibers, such as polyolefin or polyester fibers.

In general, any process capable of forming a base sheet can also be utilized in the present disclosure. For example, a papermaking process of the present disclosure can utilize embossing, wet pressing, air pressing, through-air drying, creping, uncreped through-air drying, hydroentangling, air laying, coform methods, as well as other steps known in the art.

Natural fibers such as wool, cotton, flax, hemp and wood pulp may be combined with synthetic fibers. Pulp may be modified in order to enhance the inherent characteristics of the fibers and their processability.

Optional chemical additives may also be added to the aqueous papermaking furnish or to the formed embryonic web to impart additional benefits to the product and process and are not antagonistic to the intended benefits of the invention. The following materials are included as examples of additional chemicals that may be applied to the web along with the additive composition of the present invention. The chemicals are included as examples and are not intended to limit the scope of the invention. Such chemicals may be added at any point in the papermaking process, including being added simultaneously with the additive composition, wherein said additive or additives are blended directly with the additive composition.

Additional types of chemicals that may be added to the paper web include, but are not limited to, absorbency aids usually in the form of cationic, anionic, or non-ionic surfactants, humectants and plasticizers such as low molecular weight polyethylene glycols and polyhydroxy compounds such as glycerin and propylene glycol. Materials that supply skin health benefits such as mineral oil, aloe extract, vitamine, silicone, lotions in general and the like may also be incorporated into the paper web.

In general, the products of the present invention can be used in conjunction with any known materials and chemicals that are not antagonistic to its intended use. Examples of such materials include but are not limited to odor control agents, such as odor absorbents, activated carbon fibers and particles, baby powder, baking soda, chelating agents, zeolites, perfumes or other odor-masking agents, cyclodextrin compounds, oxidizers, and the like. Superabsorbent particles, synthetic fibers, or films may also be employed. Additional options include cationic dyes, optical brighteners, humectants, emollients, and the like.

The different chemicals and ingredients that may be incorporated into the base sheet may depend upon the end use of the product. For instance, various wet strength agents may be incorporated into the product. For bath tissue products, for example, temporary wet strength agents may be used. As used herein, wet strength agents are materials used to immobilize the bonds between fibers in the wet state. Typically, the means by which fibers are held together in paper and tissue products involve hydrogen bonds and sometimes combinations of hydrogen bonds and covalent and/or ionic bonds. In some applications, it may be useful to provide a material that will allow bonding to the fibers in such a way as to immobilize the fiber-to-fiber bond points and make them resistant to disruption in the wet state. The wet state typically means when the product is largely saturated with water or other aqueous solutions.

In one aspect of the present invention the substrate is an uncreped through air dried bath tissue or "UCTAD" bath tissue. In another aspect of the present invention the substrate is a facial tissue.

Other substrate materials containing cellulosic fibers include coform webs and hydroentangled webs. In the coform process, at least one meltblown diehead is arranged near a chute through which other materials are added to a meltblown web while it is forming. Such other materials may be natural fibers, superabsorbent particles, natural polymer fibers (for example, rayon) and/or synthetic polymer fibers (for example, polypropylene or polyester), for example, where the fibers may be of staple length.

Coform processes are shown in commonly assigned U.S. Pat. No. 4,818,464 to Lau and U.S. Pat. No. 4,100,324 to Anderson et al., which are incorporated herein by reference. Webs produced by the coform process are generally referred to as coform materials. More particularly, one process for producing coform nonwoven webs involves extruding a molten polymeric material through a die head into fine streams and attenuating the streams by converging flows of high velocity, heated gas (usually air) supplied from nozzles to break the polymer streams into discontinuous microfibers of small diameter. The die head, for instance, can include at least one straight row of extrusion apertures. The coform material may contain the cellulosic material in an amount from equal or greater 50% by weight to about 90% by weight.

In addition to coform webs, hydroentangled webs can also contain synthetic and pulp fibers. Hydroentangled webs refer to webs that have been subjected to columnar jets of a fluid that cause the fibers in the web to entangle. Hydroentangling a web typically increases the strength of the web. In one embodiment, pulp fibers can be hydroentangled into a continuous filament material, such as a spunbond web. The hydroentangled resulting nonwoven composite may contain pulp fibers in an amount from equal or greater than 50% to about 90% by weight, such as in an amount of about 70% by weight. Commercially available hydroentangled composite webs as described above are commercially available from the Kimberly-Clark Corporation under the name HYDROKNIT®. Hydraulic entangling is described in, for example, U.S. Pat. No. 5,389,202 to Everhart, which is incorporated herein by reference.

Once formed, the web of the present invention may be packaged in different ways. For instance, in one embodiment, the web may be cut into individual sheets and stacked prior to being placed into a package. Alternatively, the web may be spirally wound. When spirally wound together, individual sheets may be separated from an adjacent sheet by a line of weakness, such as a perforation line. Bath tissues and paper towels, for instance, are typically supplied to a consumer in a spirally wound configuration.

Tissue webs that may be treated in accordance with the present disclosure may include a single homogenous layer of fibers or may include a stratified or layered construction. For instance, the tissue web ply may include two or three layers of fibers. Each layer may have a different fiber composition. For example, referring to FIG. 1, one embodiment of a device for forming a multi-layered stratified pulp furnish is illustrated. As shown, a three-layered headbox 10 generally includes an upper head box wall 12 and a lower head box wall 14. Headbox 10 further includes a first divider 16 and a second divider 18, which separate three fiber stock layers.

Each of the fiber layers includes a dilute aqueous suspension of papermaking fibers. The particular fiber contained in each layer generally depends upon the product being formed and the desired results. For instance, the fiber composition of each layer may vary depending on whether a bath tissue product, facial tissue product or paper towel product is being produced.

Referring to FIG. 1, an endless traveling forming fabric 26, suitably supported and driven by rolls 28 and 30, receives the layered papermaking stock issuing from head box 10. Once retained on fabric 26, the layered fiber suspension passes water through the fabric as shown by arrows 32. Water removal is achieved by combinations of gravity, centrifugal force and vacuum suction depending on the forming configuration.

When forming multiple ply products, the resulting paper product may comprise two plies, three plies, or more. Each adjacent ply may contain the coating composition or at least one of the plies adjacent to one another may contain the coating composition. The individual plies can generally be made from the same or from a different fiber furnish and can be made from the same or a different process.

The tissue web bulk may also vary from about 3 cc/g to 20 cc/g, such as from about 5 cc/g to 15 cc/g. The sheet "bulk" is calculated as the quotient of the caliper of a dry tissue sheet, expressed in microns, divided by the dry basis weight, expressed in grams per square meter. The resulting sheet bulk is expressed in cubic centimeters per gram. More specifically, the caliper is measured as the total thickness of a stack of ten representative sheets and dividing the total thickness of the stack by ten, where each sheet within the stack is placed with the same side up. Caliper is measured in accordance with TAPPI test method T411 om-89 "Thickness (caliper) of Paper, Paperboard, and Combined Board" with Note 3 for stacked sheets. The micrometer used for carrying out T411 om-89 is an Emveco 200-A Tissue Caliper Tester available from Emveco, Inc., Newberg, Oreg. The micrometer has a load of 2.00 kilo-Pascals (132 grams per square inch), a pressure foot area of 2500 square millimeters, a pressure foot diameter of 56.42 millimeters, a dwell time of 3 seconds and a lowering rate of 0.8 millimeters per second.

As described above, in one embodiment, the base sheet treated in accordance with the present disclosure may be throughdried, such as an uncreped throughdried web.

Figure 2:
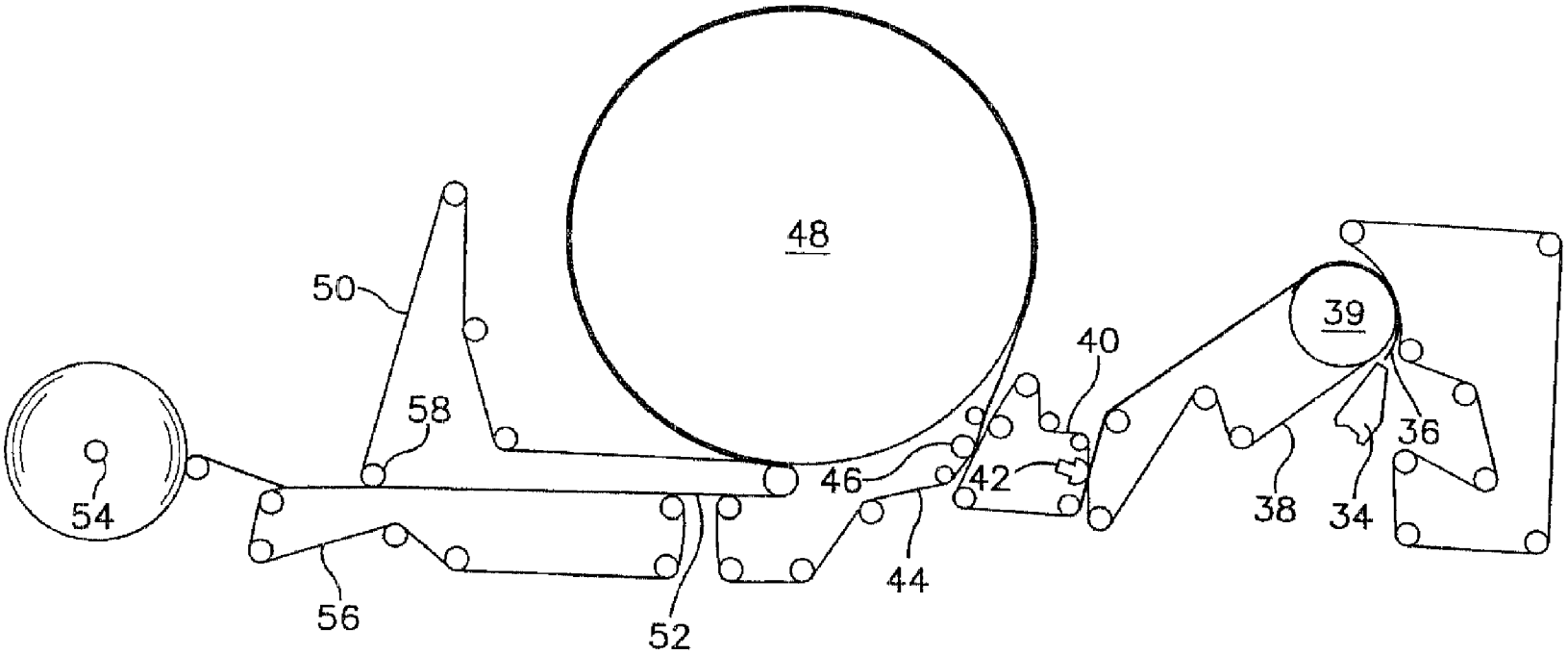
FIG. 2 is a schematic view of a system for producing uncreped, through-air dried webs.

For example, referring to FIG. 2, shown is a method for making throughdried tissue sheets. (For simplicity, the various tensioning rolls schematically used to define the several fabric runs are shown, but not numbered. It will be appreciated that variations from the apparatus and method illustrated in FIG. 2 can be made without departing from the general process). Shown is a twin wire former having a papermaking headbox 34, such as a layered headbox, which injects or deposits a stream 36 of an aqueous suspension of papermaking fibers onto the forming fabric 38 positioned on a forming roll 39. The forming fabric serves to support and carry the newly-formed wet web downstream in the process as the web is partially dewatered to a consistency of about 10 dry weight percent. Additional dewatering of the wet web can be carried out, such as by vacuum suction, while the wet web is supported by the forming fabric.

The wet web is then transferred from the forming fabric to a transfer fabric 40. In one embodiment, the transfer fabric can be traveling at a slower speed than the forming fabric in order to impart increased stretch into the web. This is commonly referred to as a "rush" transfer. Preferably the transfer fabric can have a void volume that is equal to or less than that of the forming fabric. The relative speed difference between the two fabrics can be from 0-60 percent, more specifically from about 15-45 percent. Transfer is preferably carried out with the assistance of a vacuum shoe 42 such that the forming fabric and the transfer fabric simultaneously converge and diverge at the leading edge of the vacuum slot.

The web is then transferred from the transfer fabric to the throughdrying fabric 44 with the aid of a vacuum transfer roll 46 or a vacuum transfer shoe, optionally again using a fixed gap transfer as previously described. The throughdrying fabric can be traveling at about the same speed or a different speed relative to the transfer fabric. If desired, the throughdrying fabric can be run at a slower speed to further enhance stretch. Transfer can be carried out with vacuum assistance to ensure deformation of the sheet to conform to the throughdrying fabric, thus yielding desired bulk and appearance if desired. Suitable throughdrying fabrics are described in U.S. Pat. No. 5,429,686 issued to Kai F. Chiu et al. and U.S. Pat. No. 5,672,248 to Wendt, et al. which are incorporated by reference.

In one embodiment, the throughdrying fabric contains high and long impression knuckles. For example, the throughdrying fabric can have about from about 5 to about 300 impression knuckles per square inch which are raised at least about 0.005 inches above the plane of the fabric. During drying, the web can be macroscopically arranged to conform to the surface of the throughdrying fabric and form a three-dimensional surface. Flat surfaces, however, can also be used in the present disclosure.

The side of the web contacting the throughdrying fabric is typically referred to as the "fabric side" of the paper web. The fabric side of the paper web, as described above, may have a shape that conforms to the surface of the throughdrying fabric after the fabric is dried in the throughdryer. The opposite side of the paper web, on the other hand, is typically referred to as the "air side". The air side of the web is typically smoother than the fabric side during normal throughdrying processes.

The level of vacuum used for the web transfers can be from about 3 to about 15 inches of mercury (75 to about 380 millimeters of mercury), preferably about 5 inches (125 millimeters) of mercury. The vacuum shoe (negative pressure) can be supplemented or replaced by the use of positive pressure from the opposite side of the web to blow the web onto the next fabric in addition to or as a replacement for sucking it onto the next fabric with vacuum. Also, a vacuum roll or rolls can be used to replace the vacuum shoe(s).

While supported by the throughdrying fabric, the web is finally dried to a consistency of about 94 percent or greater by the throughdryer 48 and thereafter transferred to a carrier fabric 50. The dried base sheet 52 is transported to the reel 54 using carrier fabric 50 and an optional carrier fabric 56. An optional pressurized turning roll 58 can be used to facilitate transfer of the web from carrier fabric 50 to fabric 56. Suitable carrier fabrics for this purpose are Albany International 84M or 94M and Asten 959 or 937, all of which are relatively smooth fabrics having a fine pattern. Although not shown, reel calendering or subsequent off-line calendering can be used to improve the smoothness and softness of the base sheet.

In one embodiment, the reel 54 shown in FIG. 2 can run at a speed slower than the fabric 56 in a rush transfer process for building crepe into the paper web 52. For instance, the relative speed difference between the reel and the fabric can be from about 5% to about 25% and, particularly from about 12% to about 14%. Rush transfer at the reel can occur either alone or in conjunction with a rush transfer process upstream, such as between the forming fabric and the transfer fabric.

In one embodiment, the paper web 52 is a textured web which has been dried in a three-dimensional state such that the hydrogen bonds joining fibers were substantially formed while the web was not in a flat, planar state. For instance, the web can be formed while the web is on a highly textured throughdrying fabric or other three-dimensional substrate. Processes for producing uncreped throughdried fabrics are, for instance, disclosed in U.S. Pat. No. 5,672,248 to Wendt, et al.; U.S. Pat. No. 5,656,132 to Farrington, et al.; U.S. Pat. No. 6,120,642 to Lindsay and Burazin; U.S. Pat. No. 6,096,169 to Hermans, et al.; U.S. Pat. No. 6,197,154 to Chen, et al.; and U.S. Pat. No. 6,143,135 to Hada, et al., all of which are herein incorporated by reference in their entireties.

As described above, the additive composition applied to a surface of a substrate in accordance with the present disclosure generally has a relatively high viscosity. The additive composition, for instance, may have a viscosity of greater than 500 cps, such as greater than about 800 cps. For instance, the viscosity of the additive composition may range from about 500 cps to about 3000 cps, such as from about 800 cps to about 2500 cps. In one embodiment, for instance, the viscosity of the additive composition may range from about 800 cps to about 2000 cps. As used herein, viscosity is measured using a Brookfield viscometer, Model RVDV-II+, available from Brookfield Engineering Laboratories. Measurements are taken at room temperature (23° C.), at 100 rpm, with either spindle 4 or spindle 6, depending upon the expected viscosity.

Figure 3:
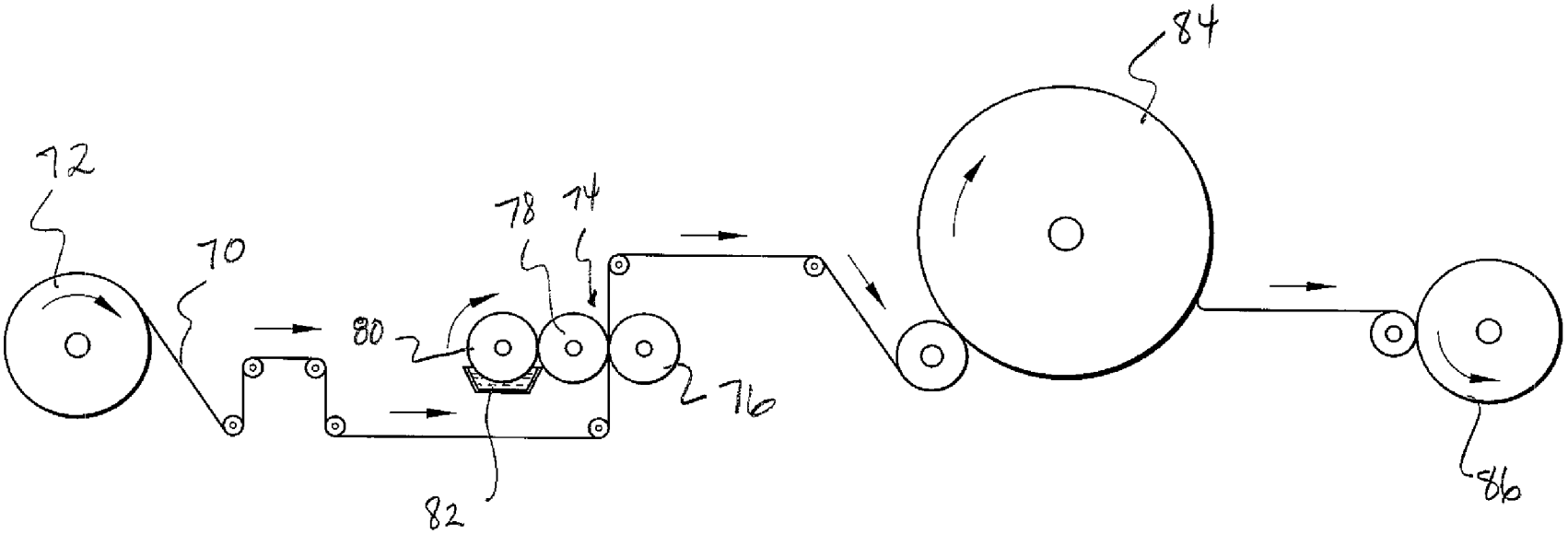
FIG. 3 is a schematic view of one embodiment of a system for applying an additive composition to a planar substrate in accordance with the present disclosure.

Referring to FIG. 3, one embodiment of a process for applying an additive composition having a relatively high viscosity as described above is illustrated. The process illustrated in FIG. 3 can be an inline process or an offline process. In FIG. 3, an offline process is shown in that a previously formed base sheet 70 is unwound from a roll of material 72 and fed into the process. As shown, the base sheet 70 is fed into a nip 74 formed between a backing roll 76 and a patterned roll 78 that includes a pattern of raised elements in accordance with the present disclosure.

In the embodiment illustrated in FIG. 3, the additive composition is contained within a bath 82 and is initially applied to an applicator roll 80. The applicator roll 80 may rotate in a clockwise direction in relation to the patterned roll 78, while the patterned roll 78 may rotate in a counterclockwise direction in relation to the backing roll 76. The applicator roll 80 may comprise any suitable roll or surface capable of transferring an additive composition onto the surface of the patterned roll 78. The applicator roll 80, for instance, may be substantially smooth, such as a chrome plated steel roll, a ceramic roll, or a rubber-coated roll. In one embodiment, the applicator roll 80 comprises an anilox roll that may be engraved and textured. For instance, the applicator roll 80 may comprise a gravure roll having a surface covered with recessed cells that hold the additive composition due to capillary action.

The manner in which the additive composition is applied to the applicator roll 80 can vary depending upon the particular application. In the embodiment illustrated, for instance, the additive composition is contained in a bath 82 and the applicator roll 80 is dipped into the bath for application to the patterned roll 78. In an alternative embodiment, the process may include a flooded nip between an applicator roll and a counter rotating roll. A pool of the additive composition is maintained within the flooded nip for application to the applicator roll.

In other embodiments, the applicator roll 80 may be at least partially enclosed within a chamber. The additive composition can be applied to the applicator roll within the chamber by flowing the composition onto the roll, by extruding the composition onto the roll, or by spraying the composition onto the roll. If desired, one or more blades may be placed adjacent to the applicator roll for maintaining the proper amount of additive composition on the applicator roll prior to contact with the patterned roll.

The additive composition can be applied to the applicator roll at ambient temperature or at elevated temperature. For instance, the additive composition may be heated in certain applications in order to control the viscosity of the composition. The additive composition can be heated using any suitable heating device, such as an infrared heater, an electrical resistance heater, a gas heater or the like. For instance, in one embodiment, the additive composition may be heated to a temperature of from about 50° C. to about 200° C., such as from about 70° C. to about 150° C.

The additive composition is transferred from the surface of the applicator roll 80 to the surface of the patterned roll 78 and then applied to the base sheet 70. The amount of composition applied to the patterned roll 78 may depend upon various factors, including the roll speeds, the viscosity of the composition, the application rate, and the particular pattern present on the patterned roll 78.

As the base sheet 70 enters the nip 74, the additive composition is applied to a surface of the base sheet. The backing roll 76 holds the base sheet 70 against the patterned roll 78 for application of the composition.

The amount of pressure applied to the base sheet 70 while in the nip 74 can be varied. In one embodiment, for instance, the nip 74 can be adjusted so that the base sheet 70 is not substantially densified during the process. The amount of pressure applied to the base sheet 70 can, in one embodiment, be less than about 200 pounds per linear inch. For instance, in various embodiments, the amount of pressure applied to the base sheet can be from about 1 pound per linear inch to about 100 pounds per linear inch, such as from about 3 pounds per linear inch to about 50 pounds per linear inch. In the above embodiments, the nip 74 may have a spacing between the patterned roll 78 and the backing roll 76 of from about 0.0001 inch to about 0.01 inches, such as from about 0.001 inches to about 0.005 inches.

As shown in FIG. 3, in one embodiment, after the additive composition is applied to a surface of the base sheet 70, the base sheet 70 is fed to a drying device 84. The drying device 84 may comprise a throughair dryer, a heated cylinder roll, an oven, or any other suitable device. After the base sheet 70 is dried, the sheet can be once again wound into a roll 86 or otherwise processed and packaged.

In accordance with the present disclosure, the patterned roll 78 includes a pattern of raised elements. In one embodiment, the patterned roll 78 includes a surface comprised of a compressible material. The compressible material may comprise, for instance, any natural or synthetic rubber or rubber-like material. In one embodiment, for instance, the patterned roll 78 may have a surface comprised of an elastomeric material. Particular materials that may be used to form the surface of the patterned roll 78 include polyesters, any suitable elastomeric polymer, or a silicone elastomer. Other materials include nitrile polymers, such as EPDM nitrile, nitrile polyvinyl chloride, carboxylated nitrile, hydrogenated nitrile, and the like. In other embodiments, the patterned roll 78 includes a surface made from a polyurethane polymer.

In accordance with the present disclosure, the surface of the patterned roll 78 includes a pattern of raised elements that apply the additive composition to the base sheet. As used herein, the term "pattern" simply means that the raised areas have surface area dimensions and are spaced apart a desired amount. The pattern of raised elements, for instance, can appear random or may have a noticeable repeat.

The raised elements on the patterned roll 78 have a surface area that contacts a surface of the base sheet. The surface of the raised elements in accordance with the present disclosure has at least one dimension that is relatively small. More particularly, the surface of the raised elements has one dimension that has a distance of less than about 500 microns. The at least one dimension, for instance, may have a distance of from about 50 microns to about 500 microns, such as from about 50 microns to about 200 microns, such as from about 75 microns to about 125 microns. The at least one relatively small dimension may be a width of the surface, a length of the surface, a diameter of the surface if the raised element is circular, or an effective diameter of the surface if the raised element has a discrete shape that is non-circular and non-rectangular.

In addition to having a surface with at least one relatively small dimension, the raised elements are also spaced closely together. In particular, at least certain of the raised elements, such as all of the raised elements, are spaced apart a distance of less than about 500 microns measured from a center of one element to a center of an adjacent element. For instance, the distance between raised elements can be from about 25 microns to about 400 microns, such as from about 25 microns to about 300 microns. Thus, the distance in between adjacent raised elements is also very small. The distance from the edge of one raised element to the edge of an adjacent raised element, for instance, may be less than about 1 micron to about 200 microns, such as from about 1 micron to about 100 microns. In one embodiment, for instance, the distance from an edge of one raised element to the edge of an adjacent raised element may be less than about 10 microns.

The present inventors discovered that using a micro-patterned surface to apply the additive composition to the base sheet as described above provides numerous advantages and benefits, especially when applying a composition having a relatively high viscosity. In particular, micro-patterned surfaces as described above allow for the additive composition to be applied to the base sheet at very high speeds without the adverse consequences of fiber buildup on the roll or the occurrence of web breaks during processing.

For example, during the process of the present disclosure, the base sheet 70 as shown in FIG. 3 may be moving at a speed of greater than 200 ft/min, such as at a speed of greater than about 500 ft/min. For instance, the base sheet may be moving at a speed of from about 500 ft/min to about 5000 ft/min.

Figure 4A:
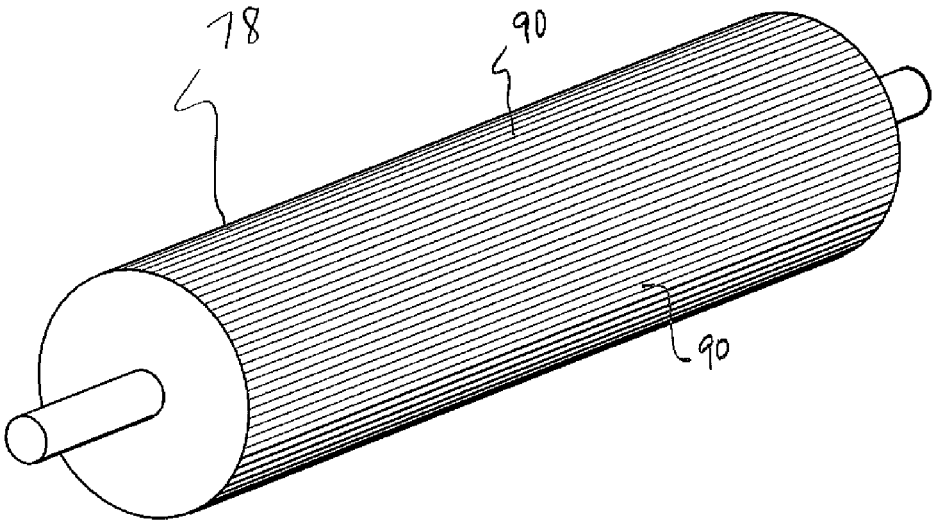
FIG. 4*a* is a perspective view of one embodiment of a patterned roll that may be used to apply additive compositions in accordance with the present disclosure.
Figure 4B:
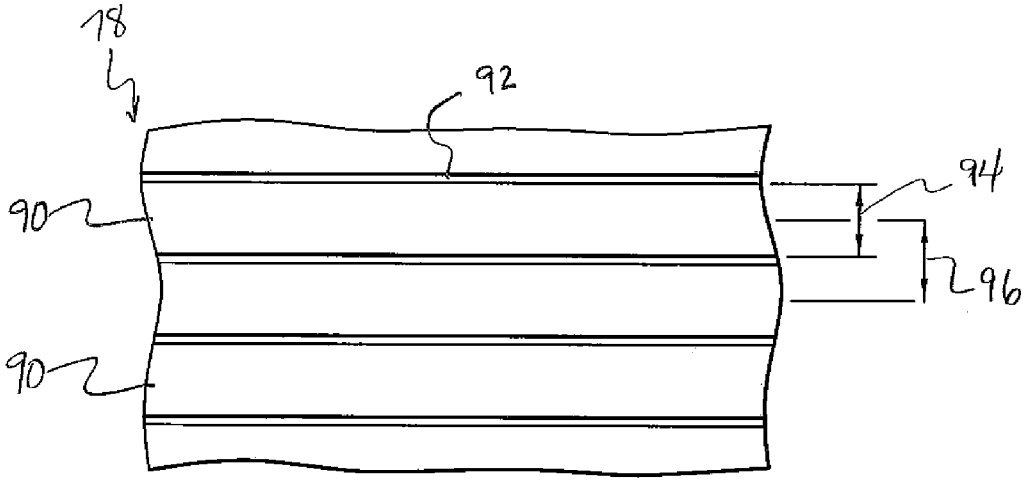
FIG. 4*b* is an enlarged partial view of the surface of the roll illustrated in FIG. 4*a;*

Referring to FIGS. 4*a* and 4*b*, one particular embodiment of a patterned roll 78 made in accordance with the present disclosure is illustrated. As shown, the patterned roll 78 defines a pattern of raised elements 90. The raised elements 90 are more particularly shown in FIG. 4*b*. As shown, the raised elements 90 are separated from each other by channels 92.

In the embodiment illustrated in FIGS. 4*a* and 4*b*, the raised elements 90 comprise line elements that extend from one end of the patterned roll to an opposite end of the patterned roll. More particularly, the line elements 90 are substantially linear and parallel with respect to one another and are positioned so as to be perpendicular to the direction in which a base sheet moves when contacted with the patterned roll 78.

It should be understood, however, that the line elements 90 may appear on the patterned roll 78 according to various other suitable patterns. For instance, in alternative embodiments, the line elements 90 may comprise curved or wavy lines. In addition, the line elements may also be positioned parallel to the direction of flow of the base sheet or may be positioned at an oblique angle to the base sheet.

As described above, the pattern of line elements 90 has relatively small dimensions. For instance, as shown in FIG. 4*b*, the line elements 90 have a width 94. In general, the width 94 is less than about 500 microns, such as from about 50 microns to about 500 microns. In one embodiment, for instance, the width 94 of the line elements 90 may be from about 75 microns to about 125 microns. In one particular embodiment, for instance, the width 94 of the line elements 90 may be 100 microns.

The line elements 90 are also positioned relatively close together. For instance, the distance of a center of one line element to the center of an adjacent line element is indicated at 96. This distance 96, for instance, may also generally be less than about 500 microns, such as from about 25 microns to about 400 microns, such as from about 25 microns to about 300 microns. For example, in one embodiment, the channels 92 may have a width of less than about 100 microns, such as less than about 50 microns, such as less than about 10 microns. In one embodiment, for instance, the width of the channels 92 can be from about 1 micron to about 10 microns.

The pattern illustrated in FIGS. 4*a* and 4*b* has been found to be particularly well suited to applying high viscosity additive compositions to base sheets having high bulk and containing pulp fibers. The use of a relatively high viscosity composition in conjunction with the patterned roll 78 shown in FIG. 4*a* can result in maintaining the composition mostly on the surface of the substrate. Depending on the composition, the properties, such as the hand feel of the base sheet, can be improved. The high viscosity composition also prevents phase inversion from occurring.

Figure 5A:
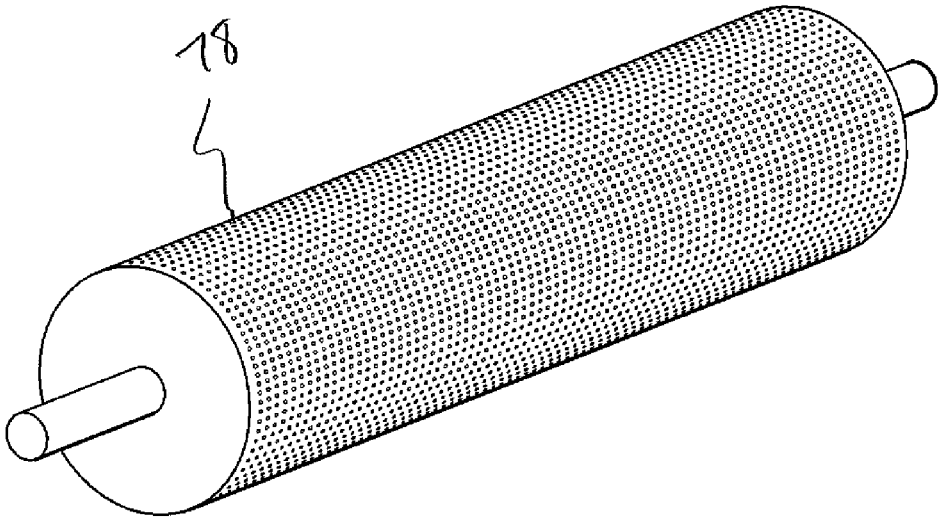
FIG. 5*a* is a perspective view of another embodiment of a patterned roll that may be used to apply additive compositions in accordance with the present disclosure.
Figure 5B:
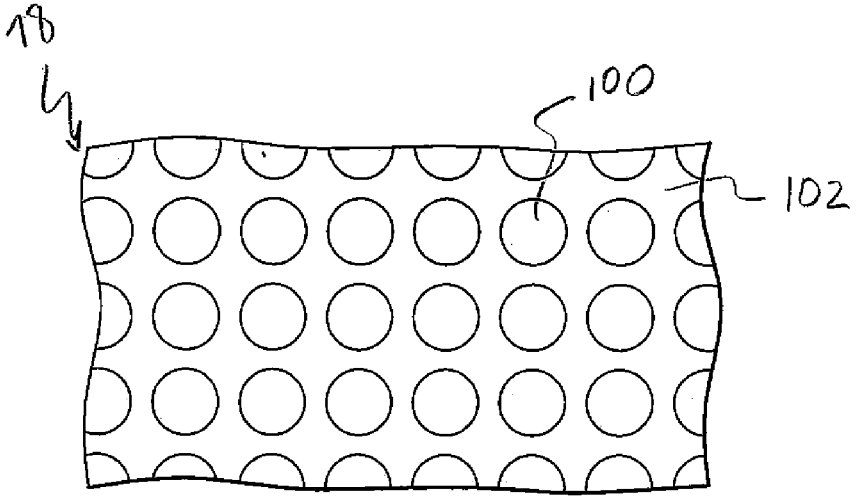
FIG. 5*b* is an enlarged partial view of the surface of the roll illustrated in FIG. 5*a*.

Referring to FIGS. 5*a* and 5*b*, another embodiment of a patterned roll 78 made in accordance with the present disclosure is illustrated. In the embodiment illustrated in FIGS. 5*a* and 5*b*, instead of including a plurality of raised line elements, the patterned roll includes a surface covered with a pattern of raised elements having discrete shapes. More particularly, as shown in FIG. 5*b*, the raised elements 100 have a circular shape and are separated by channels or recessed areas 102. In accordance with the present disclosure, the raised elements 100 have a surface that has a diameter of less than about 500 microns, such as less than 400 microns, such as less than 300 microns, such as less than 200 microns, such as less than about 100 microns. For instance, in one embodiment, the raised elements 100 may have a diameter of from about 50 microns to about 200 microns, such as from about 75 microns to about 125 microns.

In accordance with the present disclosure, the raised elements 100 as shown in FIGS. 5*a* and 5*b* are also spaced closely together. In particular, the distance from the center of one raised element to the center of an adjacent raised element is generally less than 500 microns, such as less than about 300 microns, such as less than about 200 microns. In one embodiment, for instance, the raised elements 100 may be spaced as close together as possible such that the channel width between the raised elements is less than 10 microns, such as from about 1 micron to about 5 microns.

One additional advantage to the use of a patterned roll in accordance with the present disclosure is the ability to control the amount of the additive composition transferred to the base sheet. In particular, the raised elements cannot only control the amount of surface area coverage but also can be used to control add-on, which is the weight per unit area of composition applied to the surface of the substrate. In general, the additive composition is applied to the base sheet so as to cover at least 20% of the surface area of one side of the sheet. For example, the additive composition may cover greater than 30%, such as greater than 40%, such as greater than 50%, such as greater than 60%, such as greater than 70%, such as greater than 80% of the surface area of one side of the sheet. The surface area coverage is generally less than 99%, such as less than about 95%, such as less than about 90%.

The amount of additive composition applied to the web can vary depending upon numerous factors, such as the type of composition being applied and the desired result. In one embodiment, the additive composition is applied to the web in an amount from about 1% by weight to about 20% by weight, such as in an amount from about 2% by weight to about 10% by weight. When applying a polyolefin dispersion to the base sheet, for instance, the additive composition may be applied in an amount from about 3% by weight to about 8% by weight.

The coating weight applied to the base sheet can be generally less than 50 gsm, such as less than 40 gsm, such as less than about 20 gsm, such as less than about 10 gsm. In general, the coating weight is greater than 0.1 gsm, such as greater than 1 gsm. The coating thickness can generally be in the range of from about 0.1 microns to about 100 microns, such as from about 0.1 microns to about 15 microns, such as from about 0.1 microns to about 10 microns, such as from about 0.1 microns to 5 microns.

The additive composition applied to the base sheet in accordance with the present disclosure can generally comprise any additive composition having a relatively high viscosity. In one embodiment, for instance, the additive composition may comprise an aqueous dispersion.

The aqueous dispersion comprises from 5 to 85 percent by weight of one or more base polymers, based on the total weight of the solid content of the aqueous dispersion. All individual values and subranges from 5 to 85 weight percent are included herein and disclosed herein; for example, the weight percent can be from a lower limit of 5, 8, 10, 15, 20, 25 weight percent to an upper limit of 40, 50, 60, 70, 80, or 85 weight percent. For example, the aqueous dispersion may comprise from 15 to 85, or from 15 to 85, or 15 to 80, or from 15 to 75, or from 30 to 70, or from 35 to 65 percent by weight of one or more base polymers, based on the total weight of the solid content of the aqueous dispersion. The aqueous dispersion comprises at least one or more base polymers. The base polymer can be a thermoplastic polymer or, in certain embodiments, a thermoset polymer. The one or more base polymers may comprise one or more olefin based polymers, one or more acrylic based polymers, one or more polyester based polymers, one or more solid epoxy polymers, one or more thermoplastic polyurethane polymers, one or more styrenic based polymers, or combinations thereof.

Examples of thermoplastic materials include, but are not Limited to, homopolymers and copolymers (including elastomers) of one or more alpha-olefins such as ethylene, propylene, 1-butene, 3-methyl-1-butene, 4-methyl-1-pentene, 3-methyl-1-pentene, 1-heptene, 1-hexene, 1-octene, 1-decene, and 1-dodecene, as typically represented by polyethylene, polypropylene, poly-1-butene, poly-3-methyl-1-butene, poly-3-methyl-1-pentene, poly-4-methyl-1-pentene, ethylene-propylene copolymer, ethylene-octene copolymer, ethylene-1-butene copolymer, and propylene-1-butene copolymer; copolymers (including elastomers) of an alpha-olefin with a conjugated or non-conjugated diene, as typically represented by ethylene-butadiene copolymer and ethylene-ethylidene norbornene copolymer; and polyolefins (including elastomers) such as copolymers of two or more alpha-olefins with a conjugated or non-conjugated diene, as typically represented by ethylene-propylene-butadiene copolymer, ethylene-propylene-dicyclopentadiene copolymer, ethylene-propylene-1,5-hexadiene copolymer, and ethylene-propylene-ethylidene norbornene copolymer; ethylene-vinyl compound copolymers such as ethylene-vinyl acetate copolymer, ethylene-vinyl alcohol copolymer, ethylene-vinyl chloride copolymer, ethylene acrylic acid or ethylene-(meth)acrylic acid copolymers, and ethylene-(meth)acrylate copolymer; styrenic copolymers (including elastomers) such as polystyrene, ABS, acrylonitrile-styrene copolymer, α-methylstyrene-styrene copolymer, styrene vinyl alcohol, styrene acrylates such as styrene methylacrylate, styrene butyl acrylate, styrene butyl methacrylate, and styrene butadienes and crosslinked styrene polymers; and styrene block copolymers (including elastomers) such as styrene-butadiene copolymer and hydrate thereof, and styrene-isoprene-styrene triblock copolymer; polyvinyl compounds such as polyvinyl chloride, polyvinylidene chloride, vinyl chloride-vinylidene chloride copolymer, polymethyl acrylate, and polymethyl methacrylate; polyamides such as nylon 6, nylon 6,6, and nylon 12; thermoplastic polyesters such as polyethylene terephthalate and polybutylene terephthalate; polycarbonate, polyphenylene oxide, and the like; and glassy hydrocarbon-based resins, including polydicyclopentadiene polymers and related polymers (copolymers, terpolymers); saturated mono-olefins such as vinyl acetate, vinyl propionate, vinyl versatate, and vinyl butyrate and the like; vinyl esters such as esters of monocarboxylic acids, including methyl acrylate, ethyl acrylate, n-butyl acrylate, isobutyl acrylate, 2-ethylhexyl acrylate, dodecyl acrylate, n-octyl acrylate, phenyl acrylate, methyl methacrylate, ethyl methacrylate, and butyl methacrylate and the like; acrylonitrile, methacrylonitrile, acrylamide, mixtures thereof; resins produced by ring opening metathesis and cross metathesis polymerization and the like. These resins may be used either alone or in combinations of two or more.

Exemplary (meth)acrylates, as base polymers, include, but are not limited to, methyl acrylate, ethyl acrylate, butyl acrylate, hexyl acrylate, 2-ethylhexyl acrylate, octyl acrylate and isooctyl acrylate, n-decyl acrylate, isodecyl acrylate, tert-butyl acrylate, methyl methacrylate, butyl methacrylate, hexyl methacrylate, isobutyl methacrylate, isopropyl methacrylate as well as 2-hydroxyethyl acrylate and acrylamide. The preferred (meth)acrylates are methyl acrylate, ethyl acrylate, butyl acrylate, 2-ethylhexyl acrylate, octyl acrylate, isooctyl acrylate, methyl methacrylate and butyl methacrylate. Other suitable (meth)acrylates that can be polymerized from monomers include lower alkyl acrylates and methacrylates including acrylic and methacrylic ester monomers: methyl acrylate, ethyl acrylate, n-butyl acrylate, t-butyl acrylate, 2-ethylhexyl acrylate, decyl acrylate, isobornyl acrylate, methyl methacrylate, ethyl methacrylate, n-propyl methacrylate, isopropyl methacrylate, n-butyl methacrylate, isobutyl methacrylate, sec-butyl methacrylate, cyclohexyl methacrylate, isodecyl methacrylate, isobornyl methacrylate, t-butylaminoethyl methacrylate, stearyl methacrylate, glycidyl methacrylate, dicyclopentenyl methacrylate, phenyl methacrylate.

In selected embodiments, base polymer may, for example, comprise one or more polyolefins selected from the group consisting of ethylene-alpha olefin copolymers, propylene-alpha olefin copolymers, and olefin block copolymers. In particular, in select embodiments, the base polymer may comprise one or more non-polar polyolefins.

In specific embodiments, polyolefins such as polypropylene, polyethylene, copolymers thereof, and blends thereof, as well as ethylene-propylene-diene terpolymers, may be used. In some embodiments, exemplary olefinic polymers include homogeneous polymers, as described in U.S. Pat. No. 3,645,992; high density polyethylene (HDPE), as described in U.S. Pat. No. 4,076,698; heterogeneously branched linear low density polyethylene (LLDPE); heterogeneously branched ultra low linear density polyethylene (ULDPE); homogeneously branched, linear ethylene/alpha-olefin copolymers; homogeneously branched, substantially linear ethylene/alpha-olefin polymers, which can be prepared, for example, by processes disclosed in U.S. Pat. Nos. 5,272,236 and 5,278,272, the disclosures of which are incorporated herein by reference; and high pressure, free radical polymerized ethylene polymers and copolymers such as low density polyethylene (LDPE) or ethylene vinyl acetate polymers (EVA).

In other particular embodiments, the base polymer may, for example, be ethylene vinyl acetate (EVA) based polymers. In other embodiments, the base polymer may, for example, be ethylene-methyl acrylate (EMA) based polymers. In other particular embodiments, the ethylene-alpha olefin copolymer may, for example, be ethylene-butene, ethylene-hexene, or ethylene-octene copolymers or interpolymers. In other particular embodiments, the propylene-alpha olefin copolymer may, for example, be a propylene-ethylene or a propylene-ethylene-butene copolymer or interpolymer.

In certain other embodiments, the base polymer may, for example, be a semi-crystalline polymer and may have a melting point of less than 110° C. In another embodiment, the melting point may be from 25 to 100° C. In another embodiment, the melting point may be between 40 and 85° C.

In one particular embodiment, the base polymer is a propylene/alpha-olefin copolymer, which is characterized as having substantially isotactic propylene sequences. "Substantially isotactic propylene sequences" means that the sequences have an isotactic triad (mm) measured by $^{13}C$ NMR of greater than about 0.85; in the alternative, greater than about 0.90; in another alternative, greater than about 0.92; and in another alternative, greater than about 0.93. Isotactic triads are well-known in the art and are described in, for example, U.S. Pat. No. 5,504,172 and International Publication No. WO 00/01745, which refer to the isotactic sequence in terms of a triad unit in the copolymer molecular chain determined by $^{13}C$ NMR spectra.

The propylene/alpha-olefin copolymer may have a melt flow rate in the range of from 0.1 to 25 g/10 minutes, measured in accordance with ASTM D-1238 (at 230° C./2.16 Kg). All individual values and subranges from 0.1 to 25 g/10 minutes are included herein and disclosed herein; for example, the melt flow rate can be from a lower limit of 0.1 g/10 minutes, 0.2 g/10 minutes, 0.5 g/10 minutes, 2 g/10 minutes, 4 g/10 minutes, 5 g/10 minutes, 10 g/10 minutes, or 15 g/10 minutes to an upper limit of 25 g/10 minutes, 20 g/10 minutes, 18 g/10 minutes, 15 g/10 minutes, 10 g/10 minutes, 8 g/10 minutes, or 5 g/10 minutes. For example, the propylene/alpha-olefin copolymer may have a melt flow rate in the range of from 0.1 to 20 g/10 minutes; or from 0.1 to 18 g/10 minutes; or from 0.1 to 15 g/10 minutes; or from 0.1 to 12 g/10 minutes; or from 0.1 to 10 g/10 minutes; or from 0.1 to 5 g/10 minutes.

The propylene/alpha-olefin copolymer has a crystallinity in the range of from at least 1 percent by weight (a heat of fusion of at least 2 Joules/gram) to 30 percent by weight (a heat of fusion of less than 50 Joules/gram). All individual values and subranges from 1 percent by weight (a heat of fusion of at least 2 Joules/gram) to 30 percent by weight (a heat of fusion of less than 50 Joules/gram) are included herein and disclosed herein; for example, the crystallinity can be from a lower limit of 1 percent by weight (a heat of fusion of at least 2 Joules/gram), 2.5 percent (a heat of fusion of at least 4 Joules/gram), or 3 percent (a heat of fusion of at least 5 Joules/gram) to an upper limit of 30 percent by weight (a heat of fusion of less than 50 Joules/gram), 24 percent by weight (a heat of fusion of less than 40 Joules/gram), 15 percent by weight (a heat of fusion of less than 24.8 Joules/gram) or 7 percent by weight (a heat of fusion of less than 11 Joules/gram). For example, the propylene/alpha-olefin copolymer may have a crystallinity in the range of from at least 1 percent by weight (a heat of fusion of at least 2 Joules/gram) to 24 percent by weight (a heat of fusion of less than 40 Joules/gram); or in the alternative, the propylene/alpha-olefin copolymer may have a crystallinity in the range of from at least 1 percent by weight (a heat of fusion of at least 2 Joules/gram) to 15 percent by weight (a heat of fusion of less than 24.8 Joules/gram); or in the alternative, the propylene/alpha-olefin copolymer may have a crystallinity in the range of from at least 1 percent by weight (a heat of fusion of at least 2 Joules/gram) to 7 percent by weight (a heat of fusion of less than 11 Joules/gram); or in the alternative, the propylene/alpha-olefin copolymer may have a crystallinity in the range of from at least 1 percent by weight (a heat of fusion of at least 2 Joules/gram) to 5 percent by weight (a heat of fusion of less than 8.3 Joules/gram). The crystallinity is measured via Differential scanning calorimetry (DSC) method. The propylene/alpha-olefin copolymer comprises units derived from propylene and polymeric units derived from one or more alpha-olefin comonomers. Exemplary comonomers utilized to manufacture the propylene/alpha-olefin copolymer are $C_2$, and $C_4$ to $C_{10}$ alpha-olefins; for example, $C_2$, $C_4$, $C_6$ and $C_8$ alpha-olefins.

The propylene/alpha-olefin copolymer comprises from 1 to 40 percent by weight of units derived from one or more alpha-olefin comonomers. All individual values and subranges from 1 to 40 weight percent are included herein and disclosed herein; for example, the weight percent of units derived from one or more alpha-olefin comonomers can be from a lower limit of 1, 3, 4, 5, 7, or 9 weight percent to an upper limit of 40, 35, 30, 27, 20, 15, 12, or 9 weight percent. For example, the propylene/alpha-olefin copolymer comprises from 1 to 35 percent by weight of units derived from one or more alpha-olefin comonomers; or in the alternative, the propylene/alpha-olefin copolymer comprises from 1 to 30 percent by weight of units derived from one or more alpha-olefin comonomers; or in the alternative, the propylene/alpha-olefin copolymer comprises from 3 to 27 percent by weight of units derived from one or more alpha-olefin comonomers; or in the alternative, the propylene/alpha-olefin copolymer comprises from 3 to 20 percent by weight of units derived from one or more alpha-olefin comonomers; or in the alternative, the propylene/alpha-olefin copolymer comprises from 3 to 15 percent by weight of units derived from one or more alpha-olefin comonomers.

The propylene/alpha-olefin copolymer has a molecular weight distribution (MWD), defined as weight average molecular weight divided by number average molecular weight ($M_w/M_n$) of 3.5 or less; in the alternative 3.0 or less; or in another alternative from 1.8 to 3.0.

Such propylene/alpha-olefin copolymers are further described in details in the U.S. Pat. Nos. 6,960,635 and 6,525,157, incorporated herein by reference. Such propylene/alpha-olefin copolymers are commercially available from The Dow Chemical Company, under the tradename VERSIFY™, or from ExxonMobil Chemical Company, under the tradename VISTAMAXX™.

In one embodiment, the propylene/alpha-olefin copolymers are further characterized as comprising (A) between 60 and less than 100, preferably between 80 and 99 and more preferably between 85 and 99, weight percent units derived from propylene, and (B) between greater than zero and 40, preferably between 1 and 20, more preferably between 4 and 16 and even more preferably between 4 and 15, weight percent units derived from at least one of ethylene and/or a $C_{4-10}$ α-olefin; and containing an average of at least 0.001, preferably an average of at least 0.005 and more preferably an average of at least 0.01, long chain branches/1000 total carbons, wherein the term long chain branch, as used herein, refers to a chain length of at least one (1) carbon more than a short chain branch, and short chain branch, as used herein, refers to a chain length of two (2) carbons less than the number of carbons in the comonomer. For example, a propylene/1-octene interpolymer has backbones with long chain branches of at least seven (7) carbons in length, but these backbones also have short chain branches of only six (6) carbons in length. The maximum number of long chain branches typically it does not exceed 3 long chain branches/1000 total carbons. Such propylene/alpha-olefin copolymers are further described in details in the U.S. Provisional Patent Application No. 60/988,999 and International Patent Application No. PCT/US08/082,599, each of which is incorporated herein by reference.

In certain other embodiments, the base polymer, e.g. propylene/alpha-olefin copolymer, may, for example, be a semi-crystalline polymer and may have a melting point of less than 110° C. In preferred embodiments, the melting point may be from 25 to 100° C. In more preferred embodiments, the melting point may be between 40 and 85° C.

In other selected embodiments, olefin block copolymers, e.g., ethylene multi-block copolymer, such as those described in the International Publication No. WO2005/090427 and U.S. Patent Application Publication No. US 2006/0199930, incorporated herein by reference to the extent describing such olefin block copolymers, may be used as the base polymer. Such olefin block copolymer may be an ethylene/α-olefin interpolymer:

(a) having a $M_w/M_n$ from about 1.7 to about 3.5, at least one melting point, $T_m$, in degrees Celsius, and a density, d, in grams/cubic centimeter, wherein the numerical values of $T_m$ and d corresponding to the relationship:

$$T_m > -2002.9+4538.5(d)-2422.2(d)^2; \text{ or}$$

(b) having a $M_w/M_n$ from about 1.7 to about 3.5, and being characterized by a heat of fusion, ΔH in J/g, and a delta quantity, ΔT, in degrees Celsius defined as the temperature difference between the tallest DSC peak and the tallest CRYSTAF peak, wherein the numerical values of ΔT and ΔH having the following relationships:

$$\Delta T > -0.1299(\Delta H)+62.81 \text{ for } \Delta H \text{ greater than zero and up to 130 J/g,}$$

$$\Delta T \geq 48° \text{ C. for } \Delta H \text{ greater than 130 J/g,}$$

wherein the CRYSTAF peak being determined using at least 5 percent of the cumulative polymer, and if less than 5 percent of the polymer having an identifiable CRYSTAF peak, then the CRYSTAF temperature being 30° C.; or (c) being characterized by an elastic recovery, Re, in percent at 300 percent strain and 1 cycle measured with a compression-molded film of the ethylene/α-olefin interpolymer, and having a density, d, in grams/cubic centimeter, wherein the numerical values of Re and d satisfying the following relationship when ethylene/α-olefin interpolymer being substantially free of a cross-linked phase:

$$Re > 1481-1629(d); \text{ or}$$

(d) having a molecular fraction which elutes between 40° C. and 130° C. when fractionated using TREF, characterized in that the fraction having a molar comonomer content of at least 5 percent higher than that of a comparable random ethylene interpolymer fraction eluting between the same temperatures, wherein said comparable random ethylene interpolymer having the same comonomer(s) and having a melt index, density, and molar comonomer content (based on the whole polymer) within 10 percent of that of the ethylene/α-olefin interpolymer; or (e) having a storage modulus at 25° C., G" (25° C.), and a storage modulus at 100° C., G" (100° C.), wherein the ratio of G" (25° C.) to G' (100° C.) being in the range of about 1:1 to about 9:1.

Such olefin block copolymer, e.g. ethylene/α-olefin interpolymer may also:

(a) have a molecular fraction which elutes between 40° C. and 130° C. when fractionated using TREF, characterized in that the fraction having a block index of at least 0.5 and up to about 1 and a molecular weight distribution, $M_w/M_n$, greater than about 1.3; or (b) have an average block index greater than zero and up to about 1.0 and a molecular weight distribution, $M_w/M_n$, greater than about 1.3.

In certain embodiments, the base polymer may, for example, comprise a polar polymer, having a polar group as either a comonomer or grafted monomer. In exemplary embodiments, the base polymer may, for example, comprise one or more polar polyolefins, having a polar group as either a comonomer or grafted monomer. Exemplary polar polyolefins include, but are not limited to, ethylene-acrylic acid (EAA) and ethylene-methacrylic acid copolymers, such as those available under the trademarks PRIMACOR™, commercially available from The Dow Chemical Company, NUCREL™, commercially available from E.I. DuPont de Nemours, and ESCOR™, commercially available from ExxonMobil Chemical Company and described in U.S. Pat. Nos. 4,599,392, 4,988,781, and 5,938,437, each of which is incorporated herein by reference in its entirety. Other exemplary base polymers include, but are not limited to, ethylene ethyl acrylate (EEA) copolymer, ethylene methyl methacrylate (EMMA), and ethylene butyl acrylate (EBA).

In one embodiment, the base polymer may, for example, comprise a polar polyolefin selected from the group consisting of ethylene-acrylic acid (EAA) copolymer, ethylene-methacrylic acid copolymer, and combinations thereof, and the dispersing agent may, for example, comprise a polar polyolefin selected from the group consisting of ethylene-acrylic acid (FAA) copolymer, ethylene-methacrylic acid copolymer, and combinations thereof; provided, however, that base polymer may, for example, have a lower acid number, measured according to ASTM D-974, than the dispersing agent.

Besides using an alpha-olefin copolymer as the base polymer, there is a large group of polymers suitable to be used as the base polymer. The group includes, but is not limited to, vinyl acetate homopolymers, vinylacetate maleic ester copolymers, vinyl acetate ethylene copolymers, acrylic esters, styrene butadiene copolymers, carboxylated butadiene copolymers, styrene acrylic copolymers, homopolymer and copolymers of acrylate, methacrylate esters, styrene, maleinic acid di-n-butyl ester, vinyl acetate-ethylene-acrylate terpolymers, polychloroprene rubber, polyurethane, and mixtures or combinations of each polymer. One exemplary base polymer is AFFINITY EG 8200 available from Dow Chemical Company.

The dispersion may further comprise at least one or more dispersing agents to promote the formation of a stable dispersion. In selected embodiments, the dispersing agent may be a surfactant, a polymer (different from the base polymer detailed above), or mixtures thereof. In certain embodiments, the dispersing agent can be a polar polymer, having a polar group as either a comonomer or grafted monomer.

In exemplary embodiments, the dispersing agent comprises one or more polar polyolefins, having a polar group as either a comonomer or grafted monomer. Exemplary polymeric dispersing agents include, but are not limited to, ethylene-acrylic acid (EAA) and ethylene-methacrylic acid copolymers, such as those available under the trademarks PRIMACOR, commercially available from The Dow Chemical Company. Other exemplary polymeric dispersing agents include, but are not limited to, ethylene ethyl acrylate (EEA) copolymer, ethylene methyl methacrylate (EMMA), and ethylene butyl acrylate (EBA). Other ethylene-carboxylic acid copolymer may also be used. Those having ordinary skill in the art will recognize that a number of other useful polymers may also be used.

Other dispersing agents that may be used include, but are not limited to, long chain fatty acids or fatty acid salts having from 12 to 60 carbon atoms. In some embodiments, the long chain fatty acid or fatty acid salt may have from 12 to 40 carbon atoms. In some embodiments, the dispersing agent comprises at least one carboxylic acid, a salt of at least one carboxylic acid, or carboxylic acid ester or salt of the carboxylic acid ester. One example of a carboxylic acid useful as a dispersant is a fatty acid such as montanic acid. In some desirable embodiments, the carboxylic acid, the salt of the carboxylic acid, or at least one carboxylic acid fragment of the carboxylic acid ester or at least one carboxylic acid fragment of the salt of the carboxylic acid ester has fewer than 25 carbon atoms. In other embodiments, the carboxylic acid, the salt of the carboxylic acid, or at least one carboxylic acid fragment of the carboxylic acid ester or at least one carboxylic acid fragment of the salt of the carboxylic acid ester has 12 to 25 carbon atoms. In some embodiments, carboxylic acids, salts of the carboxylic acid, at least one carboxylic acid fragment of the carboxylic acid ester or its salt has 15 to 25 carbon atoms are preferred. In other embodiments, the number of carbon atoms is 25 to 60. Some preferred salts comprise a cation selected from the group consisting of an alkali metal cation, alkaline earth metal cation, or ammonium or alkyl ammonium cation.

In other embodiments, the dispersing agent is selected from alkyl ether carboxylates, petroleum sulfonates sulfonated polyoxyethylenated alcohol, sulfated or phosphated polyoxyethylenated alcohols, polymeric ethylene oxide/propylene oxide/ethylene oxide dispersing agents, primary and secondary alcohol ethoxylates, alkyl glycosides and alkyl glycerides. Combinations any of the above-enumerated dispersing agents can also be used to prepare some aqueous dispersions.

If the polar group of the polymer is acidic or basic in nature, the polymeric dispersing agent may be partially or fully neutralized with a neutralizing agent to form the corresponding salt. In some embodiments, neutralization of the dispersing agent, such as a long chain fatty acid or EAA, may be from 25 to 200 percent on a molar basis; or in the alternative, it may be from 50 to 110 percent on a molar basis. For example, for EAA, the neutralizing agent may be a base, such as ammonium hydroxide or potassium hydroxide, for example. Other neutralizing agents can include lithium hydroxide or sodium hydroxide, for example. In another alternative, the neutralizing agent may, for example, be any amine such as monoethanolamine, or 2-amino-2-methyl-I-propanol (AMP). The degree of the neutralization varies from 50 to 100 percent on a molar basis. Desirably it should be in a range of 60 to 90 percent. Those having ordinary skill in the art will appreciate that the selection of an appropriate neutralizing agent and degree of neutralization depends on the specific composition formulated, and that such a choice is within the knowledge of those of ordinary skill in the art.

Additional dispersing agents that may be useful in the practice of the present invention include, but are not limited to, cationic surfactants, anionic surfactants, or a non-ionic surfactants. Examples of anionic surfactants include, but are not limited to, sulfonates, carboxylates, and phosphates. Examples of cationic surfactants include, but are not limited to, quaternary amines. Examples of non-ionic surfactants include, but are not limited to, block copolymers containing ethylene oxide and silicone surfactants.

Dispersing agents useful in the practice of the present disclosure can be one or more surfactants. In one embodiment, a surfactant that is used does not become chemically reacted into the base polymer during dispersion preparation. Examples of such surfactants useful herein include, but are not limited to, salts of dodecyl benzene sulfonic acid and lauryl sulfonic acid salt. Other surfactants that may be used are surfactants that do become chemically reacted into the base polymer during dispersion preparation. An example of such a surfactant useful herein includes 2,2-dimethylol propionic acid and its salts.

In some embodiments, the dispersing agent or stabilizing agent may be used in an amount ranging from greater than zero to 60 percent by weight based on the amount of base polymer (or base polymer mixture) used. For example, long chain fatty acids or salts thereof may be used from 0.5 to 10 percent by weight based on the amount of base polymer. In other embodiments, ethylene-acrylic acid or ethylene-methacrylic acid copolymers may be used in an amount from 0.01 to 80 percent by weight based on the weight of the base polymer; or in the alternative, ethylene-acrylic acid or ethylene-methacrylic acid copolymers may be used in an amount from 0.5 to 60 percent by weight based on the weight of the base polymer. In yet other embodiments, sulfonic acid salts may be used in an amount from 0.01 to 60 percent by weight based on the weight of the base polymer; or in the alternative, sulfonic acid salts may be used in an amount from 0.5 to 10 percent by weight based on the weight of the base polymer.

The type and amount of dispersing agent used can also affect end properties of the cellulose-based article formed incorporating the dispersion. For example, articles having improved oil and grease resistance might incorporate a surfactant package having ethylene-acrylic acid copolymers or ethylene-methacrylic acid copolymers in an amount from 10 to 50 percent by weight based on the total amount of base polymer. A similar surfactant package may be used when improved strength or softness is a desired end property. As another example, articles having improved water or moisture resistance might incorporate a surfactant package utilizing long chain fatty acids in an amount from 0.5 to 5 percent, or ethylene-acrylic acid copolymers in an amount from 10 to 50 percent, both by weight based on the total amount of base polymer. In other embodiments, the minimum amount of surfactant or dispersing agent is be at least 1 percent by weight based on the total amount of base polymer.

The aqueous dispersion further comprises a fluid medium. The fluid medium may be any medium; for example, the fluid medium may be water. The dispersion of the instant invention comprises 35 to 85 percent by weight of fluid medium, based on the total weight of the dispersion. In particular embodiments, the water content may be in the range of from 35 to 80, or in the alternative from 35 to 75, or in the alternative from 45 to 65 percent by weight of the fluid medium, based on the total weight of the dispersion. Water content of the dispersion may preferably be controlled so that the solids content (base polymer plus dispersing agent) is between about 5 percent to about 85 percent by weight. In particular embodiments, the solids range may be between about 10 percent to about 75 percent by weight. In other particular embodiments, the solids range is between about 20 percent to about 70 percent by weight. In certain other embodiments, the solids range is between about 25 percent to about 60 percent by weight.

Some dispersions have a pH of from greater than 7 to about 11.5, desirably from about 8 to about 11, more desirably from about 9 to about 11. The pH can be controlled by a number of factors, including the type or strength of dispersing agent, degree of neutralization, type of neutralization agent, type of base polymer to be dispersed, and melt kneading (e.g., extruder) processing conditions. The pH can be adjusted either in-situ, or by converting the carboxylic acid dispersing agent to the salt form before adding it to the base polymer and forming the dispersion. Of these, forming the salt in-situ is preferred.

The dispersion may further comprise one or more fillers. The dispersion comprises from 0.01 to 600 parts by weight of one or more fillers per hundred parts by the combined weight of the base polymer, for example, polyolefin, and the dispersing agent. According to the previous definition, a base polymer comprises one or more than one polyolefin copolymer(s) but does not include a dispersing agent. In certain embodiments, the filler loading in the dispersion can be from 0.01 to 200 parts by the weight of one or more fillers per hundred parts of the combined weight of the base polymer, for example, polyolefin, and the dispersing agent. The filler material can include conventional fillers such as milled glass, calcium carbonate, aluminum trihydrate, talc, antimony trioxide, fly ash, clays (such as bentonite or kaolin clays for example), or other known fillers.

The dispersion may further include additives. Such additives may be used with the base polymer, dispersing agent, or filler used in the dispersion without deviating from the scope of the present invention. For example, additives may include, but are not limited to, a wetting agent, surfactants, anti-static agents, antifoam agent, anti block, wax-dispersion pigments, a neutralizing agent, a thickener, a compatibilizer, a brightener, a rheology modifier (which is capable of adjusting both low and/or high shear viscosities), a biocide, a fungicide, and other additives known to those skilled in the art.

Furthermore, the aqueous dispersion may further optionally include a thickener. Thickeners can be useful in the present invention to increase the viscosity of low viscosity dispersions. Thickeners suitable for use in the practice of the present invention can be any known in the art such as for instance poly-acrylate type or associate non-ionic thickeners such as modified cellulose ethers.

Exemplary dispersion formulations such as POD (polyolefin dispersion) may include a base polymer, which may comprise at least one non-polar polyolefin; and a dispersing agent, which may include at least one polar functional group or polar comonomer; water; and optionally one or more fillers and or additives. With respect to the base polymer and the dispersing agent, in certain embodiments, the non-polar polyolefin may comprise between 30 percent to 99 percent by weight based on the total amount of base polymer and dispersing agent in the dispersion; or in the alternative, the at least one non-polar polyolefin comprises between 50 percent and 80 percent by weight based on the total amount of base polymer and dispersing agent in the dispersion; or in another alternative, the one or more non-polar polyolefins comprise about 70 percent by weight based on the total amount of base polymer and dispersing agent in the dispersion.

The aqueous dispersion can be formed by any number of methods recognized by those having skill in the art. One of the methods for producing an aqueous dispersion comprises: (1) melt kneading the base polymer and at least one dispersing agent, to form a melt-kneaded product; and (2) diluting the melt-kneaded product with water at certain temperature and under sufficient mechanical forces, and (3) melt kneading the resulting mixture to form the aqueous dispersion. In particular embodiments, the method includes diluting the melt kneaded product to provide a dispersion having a pH of less than 12. Some methods provide a dispersion with an average particle size of less than about 10 microns.

Before the coating composition is applied to an existing tissue web, the solids level of the coating composition may be about 30 percent or higher (that is, the coating composition comprises about 30 grams of dry solids and 70 grams of water, such as about any of the following solids levels or higher: 40 percent, 50 percent, 60 percent, 70 percent, with exemplary ranges of from 40 percent to 70 percent and more specifically from 40 percent to 60 percent).

As indicated above, the additive composition generally has a viscosity of greater than about 500 cps, such as greater than about 800 cps. When the additive composition comprises an aqueous dispersion as described above, the aqueous dispersion may have a viscosity of equal or greater than a value calculated by an equation of $y=40e^{0.07x}$, where y represents viscosity in a unit of centipoise and x is a percentage of an emulsifier content calculated without water. It has been found that aqueous dispersions having a viscosity equal to or greater than the above formula are particularly well suited for use in the present disclosure.

In an alternative embodiment, instead of using a thermoplastic polymer dispersion, the additive composition may comprise a lotion. For instance, in one embodiment, the lotion can be transferred to the tissue web in an amount sufficient such that the lotion then later transfers to a user's skin when wiped across the skin by a user.

In general, any suitable lotion composition may be used that has a viscosity in the desired range. Examples of lotions that may be used in accordance with the present disclosure, for instance, are disclosed in U.S. Pat. No. 5,885,697, U.S. Patent Publication No. 2005/0058693, and/or U.S. Patent Publication No. 2005/0058833, which are all incorporated herein by reference.

In one embodiment, for instance, the lotion composition may comprise an oil, a wax, a fatty alcohol, and one or more other additional ingredients.

For instance, the amount of oil in the composition can be from about 30 to about 90 weight percent, more specifically from about 40 to about 70 weight percent, and still more specifically from about 45 to about 60 weight percent. Suitable oils include, but are not limited to, the following classes of oils: petroleum or mineral oils, such as mineral oil and petrolatum; animal oils, such as mink oil and lanolin oil; plant oils, such as aloe extract, sunflower oil and avocado oil; and silicone oils, such as dimethicone and alkyl methyl silicones.

The amount of wax in the composition can be from about 10 to about 40 weight percent, more specifically from about 10 to about 30 weight percent, and still more specifically from about 15 to about 25 weight percent. Suitable waxes include, but are not limited to the following classes: natural waxes, such as beeswax and carnauba wax; petroleum waxes, such as paraffin and ceresin wax; silicone waxes, such as alkyl methyl siloxanes; or synthetic waxes, such as synthetic beeswax and synthetic sperm wax.

The amount of fatty alcohol in the composition, if present, can be from about to about 40 weight percent, more specifically from about 10 to about 30 weight percent, and still more specifically from about 15 to about 25 weight percent. Suitable fatty alcohols include alcohols having a carbon chain length of $C_{14}$-$C_{30}$, including cetyl alcohol, stearyl alcohol, behenyl alcohol, and dodecyl alcohol.

In order to better enhance the benefits to consumers, additional ingredients can be used. The classes of ingredients and their corresponding benefits include, without limitation, $C_{10}$ or greater fatty alcohols (lubricity, body, opacity); fatty esters (lubricity, feel modification); vitamins (topical medicinal benefits); dimethicone (skin protection); powders (lubricity, oil absorption, skin protection); preservatives and antioxidants (product integrity); ethoxylated fatty alcohols; (wetability, process aids); fragrance (consumer appeal); lanolin derivatives (skin moisturization), colorants, optical brighteners, sunscreens, alpha hydroxy acids, natural herbal extracts, and the like.

In one embodiment, the lotion composition can further contain a humectant. Humectants are typically cosmetic ingredients used to increase the water content of the top layers of the skin or mucous membrane, by helping control the moisture exchange between the product, the skin, and the atmosphere. Humectants may include primarily hydroscopic materials. Suitable humectants for inclusion in the moisturizing and lubrication compositions of the present disclosure include urocanic acid, N-Acetyl ethanolamine, aloe vera gel, arginine PCA, chitosan PCA, copper PCA, Corn glycerides, dimethyl imidazolidinone, fructose, glucamine, glucose, glucose glutamate, glucuronic acid, glutamic acid, glycereth-7, glycereth-12, glycereth-20, glycereth-26, glycerin, honey, hydrogenated honey, hydrogenated starch hydrolysates, hydrolyzed corn starch, lactamide MEA, lactic acid, lactose lysine RCA, mannitol, methyl gluceth-10, methyl gluceth-20, PCA, PEG-2 lactamide, PEG-10 propylene glycol, polyamino acids, polysaccharides, polyamino sugar condensate, potassium PCA, propylene glycol, propylene glycol citrate, saccharide hydrolysate, saccharide isomerate, sodium aspartate, sodium lactate, sodium PCA, sorbitol, TEA-lactate, TEA-PCA, Urea, Xylitol, and the like and mixtures thereof. Preferred humectants include polyols, glycerine, ethoxylated glycerine, polyethylene glycols, hydrogenated starch hydrolsates, propylene glycol, silicone glycol and pyrrolidone carboxylic acid.

In one embodiment, a lotion or one of the above ingredients contained in a lotion can be combined with a polymer dispersion as described above to produce an additive composition in accordance with the present disclosure having desired properties.

In still another embodiment, the additive composition may contain an adhesive, such as a latex polymer. Alternatively, the adhesive can be combined with various other components, such as a lotion or a thermoplastic resin as described above.

Latex emulsion polymers useful in accordance with this disclosure can comprise aqueous emulsion addition copolymerized unsaturated monomers, such as ethylenic monomers, polymerized in the presence of surfactants and initiators to produce emulsion-polymerized polymer particles. Unsaturated monomers contain carbon-to-carbon double bond unsaturation and generally include vinyl monomers, styrenic monomers, acrylic monomers, allylic monomers, acrylamide monomers, as well as carboxyl functional monomers. Vinyl monomers include vinyl esters such as vinyl acetate, vinyl propionate and similar vinyl lower alkyl esters, vinyl halides, vinyl aromatic hydrocarbons such as styrene and substituted styrenes, vinyl aliphatic monomers such as alpha olefins and conjugated dienes, and vinyl alkyl ethers such as methyl vinyl ether and similar vinyl lower alkyl ethers. Acrylic monomers include lower alkyl esters of acrylic or methacrylic acid having an alkyl ester chain from one to twelve carbon atoms as well as aromatic derivatives of acrylic and methacrylic acid. Useful acrylic monomers include, for instance, methyl, ethyl, butyl, and propyl acrylates and methacrylates, 2-ethyl hexyl acrylate and methacrylate, cyclohexyl, decyl, and isodecyl acrylates and methacrylates, and similar various acrylates and methacrylates.

In accordance with this disclosure, a carboxyl-functional latex emulsion polymer can contain copolymerized carboxyl-functional monomers such as acrylic and methacrylic acids, fumaric or maleic or similar unsaturated dicarboxylic acids, where the preferred carboxyl monomers are acrylic and methacrylic acid. The carboxyl-functional latex polymers comprise by weight from about 1% to about 50% copolymerized carboxyl monomers with the balance being other copolymerized ethylenic monomers. Preferred carboxyl-functional polymers include carboxylated vinyl acetate-ethylene terpolymer emulsions such as Airflex® 426 Emulsion, commercially available from Air Products Polymers, LP.

In other embodiments, the adhesive may comprise an ethylene carbon monoxide copolymer, a polyacrylate, or a polyurethane. In other embodiments, the adhesive may comprise a natural or synthetic rubber. For instance, the adhesive may comprise a styrene butadiene rubber, such as a carboxylic styrene butadiene rubber. In still another embodiment, the adhesive may comprise a starch, such as a starch blended with an aliphatic polyester.

In one embodiment, the adhesive is combined with other components to form the additive composition. For instance, the adhesive may be contained in the additive composition in an amount less than about 80% by weight, such as less than about 60% by weight, such as less than about 40% by weight, such as less than about 20% by weight, such as from about 2% by weight to about 30% by weight.

In addition, a lotion and/or a polymer dispersion may be combined with various other additives or ingredients. For instance, in one embodiment, a debonder may be present within the additive composition. A debonder is a chemical species that softens or weakens a tissue sheet by preventing the formation of hydrogen bonds.

Suitable debonding agents that may be used in the present disclosure include cationic debonding agents such as fatty dialkyl quaternary amine salts, mono fatty alkyl tertiary amine salts, primary amine salts, imidazoline quaternary salts, silicone quaternary salt and unsaturated fatty alkyl amine salts. Other suitable debonding agents are disclosed in U.S. Pat. No. 5,529,665 to Kaun which is incorporated herein by reference. In particular, Kaun discloses the use of cationic silicone compositions as debonding agents.

In one embodiment, the debonding agent used in the process of the present disclosure is an organic quaternary ammonium chloride and, particularly, a silicone-based amine salt of a quaternary ammonium chloride.

In one embodiment, the debonding agent can be PROSOFT® TQ1003, marketed by the Hercules Corporation. For example, one debonding agent that can be used is as follows:

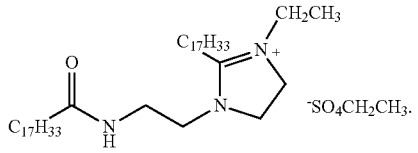

The chemical name for the above is:
1-Ethyl-2Noroleyl-3-Oleyl Amidoethyl
Imidazolinium Ethosulfate In another embodiment, the additive composition may comprise a softener, such as a polysiloxane softener.

Still in another embodiment, various beneficial agents can be incorporated into the additive composition in any amount as desired. For instance, in one embodiment, aloe, vitamin E, a wax, an oxidized polyethylene, or mixtures thereof can be combined into the additive composition in amounts less than about 5% by weight, such as from about 0.1% to about 3% by weight. Such ingredients can be combined into a lotion, into a polymer dispersion as described above, or into a mixture of both.

The present disclosure may be better understood with reference to the following examples.

Example No. 1

Additive compositions were applied to an uncreped through-air dried tissue web generally using the process illustrated in FIG. 3. Different patterned rolls were used to apply the additive compositions to the web in order to compare patterned rolls made in accordance with the present disclosure with other rolls.

The additive composition comprised an aqueous polymer dispersion. The polymer dispersion contained an alpha ethylene-octene copolymer (Dow Affinity EG8200g) in combination with an ethylene acrylic acid copolymer (Dow Primacor 5980i) in a weight ratio of 80:20 respectively. The amount of water contained in the dispersion was varied in order to vary the viscosity. The following results were obtained.

Comparative Test 1
Applicator Roll: 7.0 BCM Anilox Gravure roll
Patterned Roll: Fish-eyed patterned sleeve similar to the design illustrated in FIG. 5 of U.S. Pat. No. 7,182,837.
Viscosity of Dispersion: 1600 cps
Speed of Web: Less than 200 fpm
Result: Web stopped running after less than 100 yards due to fiber buildup and web breakage.

Comparative Test 2
Applicator Roll: 7.0 BCM Anilox Gravure roll
Patterned Roll Fish-eyed patterned sleeve similar to the design illustrated in FIG. 5 of U.S. Pat. No. 7,182,837.
Viscosity of Dispersion: 1260 cps
Speed of Web: Less than 800 fpm
Result: Process had to be stopped every 200 yards in order to clean for fiber buildup on the applicator roll.

Comparative Test 3
Applicator Roll: 7.0 BCM Anilox Gravure roll
Patterned Roll Plain rubber roll (no pattern)
Viscosity of Dispersion: 1600 cps
Speed of Web: Less than 50 fpm
Result: Had to clean roll every 500 yards even at speeds less than 50 fpm to remove fiber buildup, otherwise the web will be broken.

Test No. 1
Applicator Roll: 7.0 BCM Anilox Gravure roll
Patterned Roll The applicator roll included circular raised elements in three zones. The raised elements had a diameter of 250 microns. In each zone, the spacing between the raised elements (edge to edge) varied from 1000 microns, to 500 microns, to less than 5 microns.
Viscosity of Dispersion: 820 cps
Speed of Web: Less than 50 fpm
Results: During the test, it was observed that as the spacing between the raised elements increased, the fiber buildup increased.

Test No. 2
Applicator Roll: 7.0 BCM Anilox gravure roll
Patterned Roll Patterned roll with line elements as shown in FIGS. 4*a* and 4*b*
Viscosity of Dispersion: 820 cps
Speed of Web: Up to 2000 fpm Result: The process could run over 5000 yards of material at a time without substantial fiber buildup at very fast speeds. Also discovered that the process could run with nip distances of less than 0.001 inches.

Example No. 2

During this example, the following test methods were used.

In-Hand Ranking Test for Tactile Properties (IHR Test):

The In-Hand Ranking Test (IHR) is a basic assessment of in-hand feel of fibrous webs and assesses attributes such as softness and stiffness. It can provide a measure of generalizability to the consumer population.

The Softness test involves evaluating the velvety, silky or fuzzy feel of the tissue sample when rubbed between the thumb and fingers. The Stiffness test involves gathering a flat sample into one's hand and moving the sample around in the palm of the hand by drawing the fingers toward the palm and evaluating the amount of pointed, rigid or cracked edges or peaks felt.

Rank data generated for each sample code by the panel are analyzed using a proportional hazards regression model. This model assumes computationally that the panelist proceeds through the ranking procedure from most of the attribute being assessed to least of the attribute. The softness and stiffness test results are presented as log odds values. The log odds are the natural logarithm of the risk ratios that are estimated for each code from the proportional hazards regression model. Larger log odds indicate the attribute of interest is perceived with greater intensity.

The IHR is employed to obtain a holistic assessment of softness and stiffness, or to determine if product differences are humanly perceivable. This panel is trained to provide assessments more accurately than an average untrained consumer might provide. The IHR is useful in obtaining a quick read as to whether a process change is humanly detectable and/or affects the softness or stiffness perception, as compared to a control. The difference of the IHR Softness Data between a treated web and a control web reflects the degree of softness improvement. Since the IHR results are expressed in log odds, the difference in improved softness is actually much more significant than the data indicates. For example, when the difference of IHR data is 1, it actually represents 10 times ($10^1$=10) improvement in overall softness, or 1,000% improvement over its control. For another example, if the difference is 0.2, it represents 1.58 times ($10^{0.2}$=1.58) or a 58% improvement.

The data from the IHR can also be presented in rank format. The data can generally be used to make relative comparisons within tests as a product's ranking is dependent upon the products with which it is ranked. Across-test comparisons can be made when at least one product is tested in both tests.

Geometric Mean Tensile (GMT) Strength

As used herein, the "geometric mean tensile (GMT) strength" is the square root of the product of the machine direction tensile strength multiplied by the cross-machine direction tensile strength. The "machine direction (MD) tensile strength" is the peak load per 3 inches (76.2 mm) of sample width when a sample is pulled to rupture in the machine direction. Similarly, the "cross-machine direction (CD) tensile strength" is the peak load per 3 inches (76.2 mm) of sample width when a sample is pulled to rupture in the cross-machine direction. The "stretch" is the percent elongation of the sample at the point of rupture during tensile testing. The procedure for measuring tensile strength is as follows.

Samples for tensile strength testing are prepared by cutting a 3 inches (76.2 mm) wide by 5 inches (127 mm) long strip in the machine direction (MD) or cross-machine direction (CD) orientation using a JDC Precision Sample Cutter (Thwing-Albert Instrument Company, Philadelphia, Pa., Model No. JDC3-10, Serial No. 37333). The instrument used for measuring tensile strength is an MTS Systems Insight 1 Material Testing Work Station. The data acquisition software is MTS TestWorks® 4 (MTS Systems Corp., 14000 Technology Driver, Eden Prairie, Minn. 55344). The load cell is selected from either a 50 Newton or 100 Newton maximum (S-Beam TEDS ID Load Cell), depending on the strength of the sample being tested, such that the majority of peak load values fall between 10-90% of the load cell's full scale value. The gauge length between jaws is 4±0.04 inches (101.6±1 mm). The jaws are operated using pneumatic-action and are rubber coated. The minimum grip face width is 3 inches (76.2 mm), and the approximate height of a jaw is 0.5 inches (12.7 mm). The crosshead speed is 10±0.4 inches/min (254±1 mm/min), and the break sensitivity is set at 65%. The data is recorded at 100 hz. The sample is placed in the jaws of the instrument, centered both vertically and horizontally. The test is then started and ends when the specimen breaks. The peak load is recorded as the "MD tensile strength" or the "CD tensile strength" of the specimen. At least six (6) representative specimens are tested for each product or sheet, taken "as is", and the arithmetic average of all individual specimen tests is the MD or CD tensile strength for the product or sheet. Tensile strength test results are reported in units of grams-force (gf).

Slough Test

Figure 6:
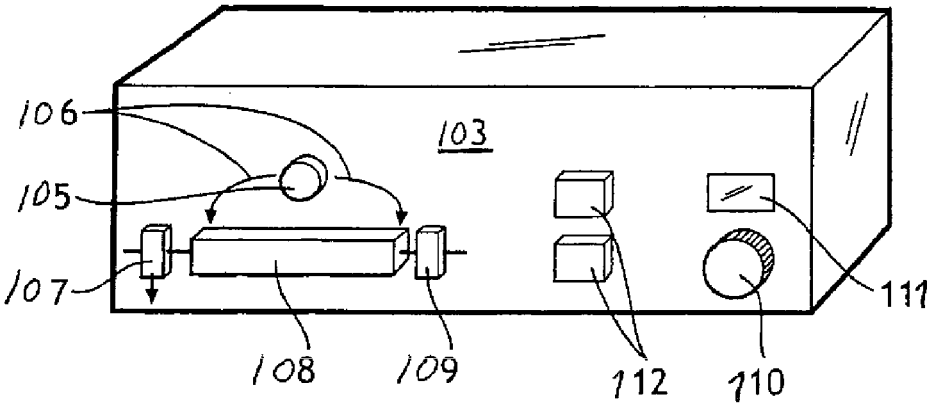
FIG. 6 is a perspective view of a device that may be used in measuring slough.

Slough Measurement:

In order to determine the abrasion resistance, or tendency of the fibers to be rubbed from the tissue sheet when handled, each sample was measured by abrading the tissue specimens via the following method. This test measures the resistance of a material to an abrasive action when the material is subjected to a horizontally reciprocating surface abrader. The equipment and method used is similar to that described in U.S. Pat. No. 4,326,000, issued on Apr. 20, 1982 to Roberts, Jr. and assigned to the Scott Paper Company, the disclosure of which is herein incorporated by reference to the extent that it is non-contradictory herewith. All tissue sheet samples were conditioned at 23° C.±1° C. and 50±2% relative humidity for a minimum of 4 hours. FIG. 6 is a schematic diagram of the test equipment. Shown is the abrading spindle or mandrel 105, a double arrow 106 showing the motion of the mandrel 105, a sliding clamp 107, a slough tray 108, a stationary clamp 109, a cycle speed control 110, a counter 111, and start/stop controls 112.

The abrading spindle 105 consists of a stainless steel rod, 0.5" in diameter with the abrasive portion consisting of a 0.005" deep diamond pattern knurl extending 4.25" in length around the entire circumference of the rod. The abrading spindle 105 is mounted perpendicularly to the face of the instrument 103 such that the abrasive portion of the abrading spindle 105 extends out its entire distance from the face of the instrument 103. On each side of the abrading spindle 105 is located a pair of clamps 107 and 109, one movable 107 and one fixed 109, spaced 4" apart and centered about the abrading spindle 105. The movable clamp 107 (weighing approximately 102.7 grams) is allowed to slide freely in the vertical direction, the weight of the movable clamp 107 providing the means for insuring a constant tension of the tissue sheet sample over the surface of the abrading spindle 5.

Using a JDC-3 or equivalent precision cutter, available from Thwing-Albert Instrument Company, located at Philadelphia, Pa., the tissue sheet sample specimens are cut into 3"±0.05" wide×7" long strips (note: length is not critical as long as specimen can span distance so as to be inserted into the clamps A & B). For tissue sheet samples, the MD direction corresponds to the longer dimension. Each tissue sheet sample is weighed to the nearest 0.1 mg. One end of the tissue sheet sample is clamped to the fixed clamp 109, the sample then loosely draped over the abrading spindle or mandrel 105 and clamped into the sliding clamp 107. The entire width of the tissue sheet sample should be in contact with the abrading spindle 105. The sliding clamp 107 is then allowed to fall providing constant tension across the abrading spindle 105.

The abrading spindle 105 is then moved back and forth at an approximate 15 degree angle from the centered vertical centerline in a reciprocal horizontal motion against the tissue sheet sample for 20 cycles (each cycle is a back and forth stroke), at a speed of 170 cycles per minute, removing loose fibers from the surface of the tissue sheet sample. Additionally the spindle rotates counter clockwise (when looking at the front of the instrument) at an approximate speed of 5 RPMs. The tissue sheet sample is then removed from the jaws 107 and 109 and any loose fibers on the surface of the tissue sheet sample are removed by gently shaking the tissue sheet sample. The tissue sheet sample is then weighed to the nearest 0.1 mg and the weight loss calculated. Ten tissue sheet specimen per sample are tested and the average weight loss value in mg recorded. The result for each tissue sheet sample was compared with a control sample containing no chemicals. Where a 2-layered tissue sheet sample is measured, placement of the tissue sheet sample should be such that the hardwood portion is against the abrading surface.

In the following example, an uncreped through-air dried tissue web having a basis weight of about 40 gsm was treated with an additive composition as described in Example No. 1 above generally using the process illustrated in FIG. 3. During the different tests, different patterned rolls were used to apply the additive composition to the tissue web. An untreated tissue web was also tested.

The following is a description of each pattern roll for each sample tested.

Sample No. 1: The patterned roll included line elements and was similar to the embodiment illustrated in FIG. 4*a*. The line elements had a width of 100 microns and the channels dividing the line elements were only a few microns.

Sample No. 2: The patterned roll included raised circular elements having a diameter of 250 microns. The spacing between the raised elements was 1000 microns.

Sample No. 3: The patterned roll included raised circular elements having a diameter of 250 microns. The spacing between the raised elements was 500 microns.

Sample No. 4: The patterned roll included raised circular elements having a diameter of 250 microns. The raised elements were touching at adjacent edges.

Sample No. 5: Same patterned sleeve as used in Sample No. 3.

The following results were obtained.

| Sample No. | Ratio of AFFINITY to PRIMACOR | Viscosity of dispersion (cps) | Surface Coverage (theoretical) | Add-On (%) | Softness (IHR) | GMT (gf) | % Slough Reduction |
|---|---|---|---|---|---|---|---|
| Control | | | 0 | | 0 | 895.9 | |
| 1 | 80/20 | 820 | 50 | 8 | 0.67 | 1060.4 | 33.96 |
| 2 | 80/20 | 820 | 10 | 0.8 | −0.52 | 993.7 | 7.54 |
| 3 | 80/20 | 820 | 20 | 8 | 0.55 | 1077 | |
| 4 | 80/20 | 820 | 78 | 4.12 | 0.03 | 1123 | 10.84 |
| 5 | 60/40 | 1080 | 20 | 5.12 | 1.74 | 1145 | 43.39 |

These and other modifications and variations to the present invention may be practiced by those of ordinary skill in the art, without departing from the spirit and scope of the present invention, which is more particularly set forth in the appended claims. In addition, it should be understood that aspects of the various embodiments may be interchanged both in whole or in part. Furthermore, those of ordinary skill in the art will appreciate that the foregoing description is by way of example only, and is not intended to limit the invention so further described in such appended claims.

What is claimed:

1. A process for applying an additive composition to a surface of a substrate comprising:

applying an additive composition to a surface of a first roll;

transferring the additive composition from the surface of the first roll to a surface of a second roll, the surface of the second roll comprising a compressible material defining a pattern of raised elements, each of the raised elements having a surface in which at least one dimension of the surface is less than about 500 microns, all of the adjacent raised elements in the pattern being spaced apart a distance of less than about 500 microns measured from a center of one element to a center of an adjacent element; and applying the additive composition from the surface of the second roll to a surface of a planar substrate, the planar substrate containing pulp fibers, the additive composition containing a polymeric material and having a viscosity of at least 500 cps, the additive composition covering at least 20% of the surface area of the surface of the planar substrate, the planar substrate moving at a speed of at least 500 ft/min during application of the additive composition.

2. A process as defined in claim 1, wherein the raised elements have discrete shapes that have an effective diameter of less than about 500 microns.

3. A process as defined in claim 2, wherein the raised elements have a circular shape.

* * * * *